US010254039B2

(12) United States Patent
Joo et al.

(10) Patent No.: US 10,254,039 B2
(45) Date of Patent: Apr. 9, 2019

(54) REFRIGERATOR, DOOR ASSEMBLY THEREFOR, AND METHOD FOR PRODUCING DOOR ASSEMBLY

(71) Applicant: SAMSUNG ELECTRONICS CO., LTD., Suwon-si, Gyeonggi-do (KR)

(72) Inventors: Sun Hwan Joo, Suwon-si (KR); Seung Yong Yang, Gwangju (KR); Sang Gyu Jung, Gwangju (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 15/989,717

(22) Filed: May 25, 2018

(65) Prior Publication Data

US 2018/0320952 A1 Nov. 8, 2018

Related U.S. Application Data

(62) Division of application No. 15/110,205, filed as application No. PCT/KR2015/000155 on Jan. 7, 2015, now Pat. No. 10,012,426.

(30) Foreign Application Priority Data

Jan. 7, 2014 (KR) ..... 10-2014-0002067
Aug. 14, 2014 (KR) ..... 10-2014-0106155

(51) Int. Cl.
*A47B 96/04* (2006.01)
*F25D 23/02* (2006.01)
(Continued)

(52) U.S. Cl.
CPC ..... *F25D 23/02* (2013.01); *F25D 11/02* (2013.01); *F25D 23/028* (2013.01); *F25D 23/04* (2013.01);
(Continued)

(58) Field of Classification Search
CPC ..... F25D 23/028
(Continued)

(56) References Cited

U.S. PATENT DOCUMENTS 2,837,183 A 6/1958 Heiman
3,786,613 A 1/1974 Shepheard
(Continued)

FOREIGN PATENT DOCUMENTS

JP 50-124661 10/1975
JP 54-167848 11/1979
(Continued)

OTHER PUBLICATIONS

Written Opinion (Form PCT/ISA/237); dated Apr. 13, 2015 in corresponding International Patent Application No. PCT/KR2015/000155 (7 pages) (10 pages English Translation).
(Continued)

*Primary Examiner* — Matthew W Ing
(74) *Attorney, Agent, or Firm* — Staas & Halsey LLP

(57) ABSTRACT

A door assembly configured to open and close a storage compartment of a refrigerator. A refrigerator including a body; a storage compartment placed inside of the body and provided with an open front side, and a door assembly configured to open and close the open front side of the storage compartment. The door assembly includes a front panel forming a front side and opposite sides of the door assembly, a rear panel coupled to the opposite sides of the front panel in a rear side of the front panel, a door cap configured to cover an upper side or a lower side of the door assembly, and a connection member provided with a first connection unit coupled to the front panel and a second connection unit coupled to the door cap.

6 Claims, 44 Drawing Sheets

(51) Int. Cl.

| | |
|---|---|
| ***F25D 23/04*** | (2006.01) |
| ***F25D 11/02*** | (2006.01) |
| ***F25D 23/12*** | (2006.01) |
| ***F25D 25/02*** | (2006.01) |

(52) U.S. Cl.
CPC ..... *F25D 23/126* (2013.01); *F25D 25/021* (2013.01); *F25D 2323/021* (2013.01); *F25D 2400/36* (2013.01)

(58) Field of Classification Search
USPC ..... 312/401, 405, 405.1
See application file for complete search history.

(56) References Cited

U.S. PATENT DOCUMENTS

| | | | |
|---|---|---|---|
| 4,583,796 | A | 4/1986 | Nakajima |
| 6,722,083 | B2 | 4/2004 | Herrmann |
| 7,866,773 | B2 | 1/2011 | Leimkuehler |
| 9,279,609 | B2 | 3/2016 | Kim |
| 9,303,915 | B2 | 4/2016 | Kim |
| 9,500,402 | B2 | 11/2016 | Bianchi |
| 9,810,475 | B2 | 11/2017 | Kim |
| 9,890,990 | B2 | 2/2018 | Allard |
| 2004/0194253 | A1 | 10/2004 | Jung |

FOREIGN PATENT DOCUMENTS

| | | | |
|---|---|---|---|
| JP | 06-265263 | A | 9/1994 |
| JP | 8-35761 | | 2/1996 |
| JP | 08-35761 | A | 2/1996 |
| JP | 2003-50082 | | 2/2003 |
| JP | 2003-166779 | | 6/2003 |
| KR | 10-2001-0111427 | | 12/2001 |
| KR | 10-2010-0365920 | | 12/2002 |
| KR | 10-2004-0082515 | | 9/2004 |
| KR | 10-2010-0057246 | | 5/2010 |
| WO | 2009/112499 | A1 | 9/2009 |
| WO | WO 2015/105331 | | 7/2015 |

OTHER PUBLICATIONS

International Search Report (Form PCT/ISA/210); dated Apr. 13, 2015 in corresponding International Patent Application No. PCT/KR2015/000155 (3 pages) (2 pages English Translation).
Australian Examination Report dated Dec. 19, 2016 in related Australian Patent Application No. 2015205138 (3 pages).
Australian Notice of Acceptance dated Apr. 6, 2017 in related Australian Patent Application No. 2015205138 (3 pages).
Canadian Office Action dated Apr. 24, 2017 in related Canadian Patent Application No. 2,936,059 (4 pages).
Extended European Search Report dated Aug. 10, 2017 in corresponding European Patent Application No. 15735242.8.
Canadian Office Action dated Jan. 2, 2018 in Canadian Patent Application No. 2,936,059.
Chinese Office Action dated Apr. 2, 2018 in Chinese Patent Application No. 201580012588.5.
U.S. Notice of Allowance dated Mar. 13, 2018 and Corrected Notice of allowance dated Apr. 11, 2018 in U.S. Appl. No. 15/110,205.
U.S. Office Action dated Nov. 15, 2017 in U.S. Appl. No. 15/110,205.
U.S. Office Action dated Jun. 14, 2017 in U.S. Appl. No. 15/110,205.
U.S. Appl. No. 15/110,205, filed Jul. 7, 2016, Sun Hwan Joo, et al., Samsung Electronics Co., Ltd.
Canadian Office Action dated Aug. 31, 2018 in Canadian Patent Application No. 2,936,059.
Korean Notice of Allowance dated Nov. 6, 2018 in Korean Patent Application No. 201580012588.5.

REFRIGERATOR, DOOR ASSEMBLY THEREFOR, AND METHOD FOR PRODUCING DOOR ASSEMBLY

CROSS-REFERENCE TO RELATED APPLICATIONS

This application is a divisional application of U.S. patent application Ser. No. 15/110,205, filed on Jul. 7, 2016, which is a U.S. National stage application of PCT international application PCT/KR2015/000155, filed on Jan. 7, 2015 and claims the benefits of Korean Patent Application No. 10-2014-0002067, filed on Jan. 7, 2014, and Korean Patent Application No. 10-2014-0106155, filed on Aug. 14, 2014, respectively, the contents are incorporated herein by reference.

BACKGROUND

1. Technical Field

Embodiments of the present disclosure relate to a door assembly configured to open and close a storage compartment of a refrigerator.

2. Background Art

A refrigerator is a home appliance including a storage compartment to store food, and a cold air supplier to supply cold air to the storage compartment in order to keep food fresh. The storage compartment has a shape having an open front side, and the open front side of the storage compartment is opened and closed by a door.

A door of a refrigerator is manufactured by coupling a plurality of panels. In general, a door is typically configured with a front panel forming a front side and a lateral side, a rear panel forming an inner space by being coupled to the front panel, and a door cap coupled to an upper side and a lower side of the inner space formed by the front panel and the rear panel.

A plurality of coupling member is provided in a position in which the door cap and the front panel corresponds to each other, respectively. A coupling member of the door cap is coupled to a coupling member of the front panel corresponding to the door cap in a forced insertion method. In this case, the shape of the front panel may be deformed or cracking or debonding may be generated among a plurality of panels forming the door.

SUMMARY

Therefore, it is an aspect of the present disclosure to provide a refrigerator having an improved structure to improve the productivity of a door assembly by simplifying a manufacturing process of the door assembly, a door assembly applied to the refrigerator, and a method for producing a door assembly.

It is another aspect of the present disclosure to provide a refrigerator having an improved structure to prevent a cracking and a deboning in a manufacturing process of a door assembly, a door assembly applied to the refrigerator, and a method for producing a door assembly.

It is another aspect of the present disclosure to provide a refrigerator having an improved structure to improve the product reliability by preventing deformation and damage that may occur in a manufacturing process of a door assembly, a door assembly applied to the refrigerator, and a method for producing a door assembly.

In accordance with an aspect of the present invention, A refrigerator comprising:

a body; a storage compartment placed inside of the body and provided with an open front side; and a door assembly configured to open and close the open front side of the storage compartment wherein the door assembly comprises a front panel forming a front side and opposite sides of the door assembly; a rear panel coupled to the opposite sides of the front panel in a rear side of the front panel; a door cap configured to cover an upper side or a lower side of the door assembly; and a connection member provided with a first connection unit coupled to the front panel and a second connection unit coupled to the door cap.

Also, the first connection unit comprises at least one first locking unit, wherein at least one first coupling hole to which the first locking unit is coupled is provided in an upper portion or a lower portion of the front panel.

Also, the first connection unit further comprises a first groove formed in one side of the connection member, wherein the front panel is coupled to the connection member such that at least one portion of the front panel is placed inside of the first groove.

Also, the front panel comprises a first coupling unit extended from an upper end to an inner side and a second coupling unit extended from one side of the first coupling unit to a lower side, wherein the first coupling hole is provided in the second coupling unit.

Also, the second connection unit comprises at least one second coupling hole, wherein the door cap comprises at least one door cap coupling member disposed inside of the door cap to be extended to an inner side direction of the door assembly to be coupled to the second coupling hole.

Also, the second connection unit further comprises a second groove provided in parallel to the first groove, wherein the second coupling hole is provided in one side of an inside of the second groove.

Also, the second groove is provided more inner side of the door assembly than the first groove.

Also, the connection member further comprises a guide unit provided in an outside of the first coupling unit to have a shape corresponding to a space surrounded by the front side of the front panel, the first coupling unit and the second coupling unit.

Also, an upper side of the door cap is placed in the same height as an upper side of the front panel.

In accordance with another aspect of the present disclosure, a method for producing a door assembly configured to open and close a storage compartment of a refrigerator comprising: coupling a connection member to an upper portion or a lower portion of a front panel; coupling a door cap to the connection member; and coupling a rear panel to a rear surface of the front panel and the door cap, wherein the front panel is fixed to the door cap by coupling the door cap to the connection member coupled to the front panel.

Also, during coupling the connection member to the front panel, a first locking unit provided in the connection member is insertedly coupled to a first coupling hole provided in one side of the front panel.

Also, the front panel comprises a first coupling unit extended from an upper end to an inner side and a second coupling unit provided with the first coupling hole and configured to be extended from one side of the first coupling unit to a lower side, wherein during coupling the connection member to the front panel, the first locking unit is coupled to the first coupling hole in a state in which the second coupling unit is inserted into a first groove provided in one side of the connection member.

Also, the connection member further comprises a guide unit provided in an outside of the first groove to have a shape corresponding to a space surrounded by the front side of the front panel, the first coupling unit and the second coupling unit, wherein during coupling the connection member to the front panel, the guide unit is moved to an upper portion along an inner side of the front panel to couple the connection member to the front panel.

Also, during coupling the door cap to the connection member, a door cap coupling member provided in the door cap is insertedly coupled to a second coupling hole provided in one side of the connection member.

Also, the connection unit further comprises a second groove provided in parallel to the first groove, wherein during coupling the door cap to the connection member, the door cap coupling member is insertedly coupled to a second coupling hole provided in an inside of the second groove.

Also, the second groove is provided more inner side of the door assembly than the first groove.

In accordance with another aspect of the present disclosure, a door assembly configured to open and close an open storage compartment of a refrigerator comprising: a front panel forming a front side and opposite sides of the door assembly; a rear panel coupled to the opposite sides of the front panel in a rear side of the front panel; a door cap configured to cover an upper side or a lower side of the door assembly; and a connection member coupled to the front panel and the door cap and configured to fix the door cap to one side of the front panel.

Also, the connection member comprises at least one first locking unit, wherein at least one first coupling hole to which the first locking unit is coupled is provided in an upper portion or a lower portion of the front panel.

Also, the front panel comprises a first coupling unit extended from an upper end to an inner side and a second coupling unit extended from one side of the first coupling unit to a lower side, wherein the first coupling hole is provided in the second coupling unit.

Also, the first connection unit further comprises a first groove formed in one side of the connection member, wherein the front panel is coupled to the connection member such that at least one portion of the second coupling unit is placed inside of the first groove.

Also, the connection unit comprises at least one second coupling hole, wherein the door cap comprises at least one door cap coupling member disposed inside of the door cap to be extended to an inner side direction of the door assembly to be coupled to the second coupling hole.

Also, the connection unit further comprises a second groove provided in parallel to the first groove, wherein the second coupling hole is provided in one side of an inside of the second groove.

Also, the second groove is provided more inner side of the door assembly than the first groove.

Also, the connection member further comprises a guide unit provided in an outside of the first coupling unit to have a shape corresponding to a space surrounded by the front side of the front panel, the first coupling unit and the second coupling unit.

In accordance with one aspect of the present disclosure, it may be possible to improve the productivity of a door assembly by simplifying a manufacturing process of the door assembly.

In accordance with another aspect of the present disclosure, it may be possible to prevent a cracking and a deboning in a manufacturing process of a door assembly.

In accordance with another aspect of the present disclosure, it may be possible to improve the product reliability by preventing deformation and damage that may occur in a manufacturing process of a door assembly.

BRIEF DESCRIPTION OF THE DRAWINGS

These and/or other aspects of the present disclosure will become apparent and more readily appreciated from the following description of the embodiments, taken in conjunction with the accompanying drawings of which.

DESCRIPTION OF EMBODIMENTS

Figure 1:
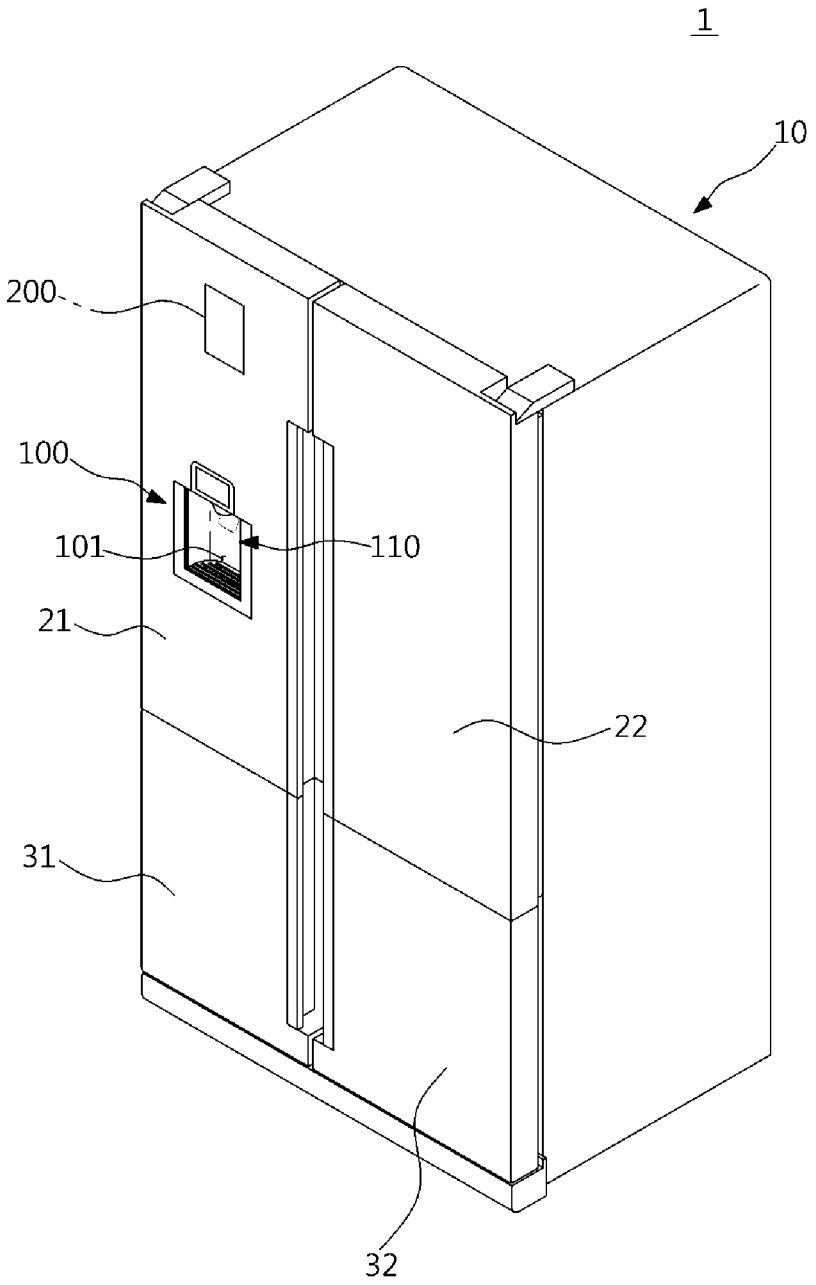
FIG. 1 is a perspective view illustrating an exterior of a refrigerator according to an embodiment of the present disclosure.

Reference will now be made in detail to embodiments of the present disclosure, examples of which are illustrated in the accompanying drawings, wherein like reference numerals refer to like elements throughout.

Figure 2:
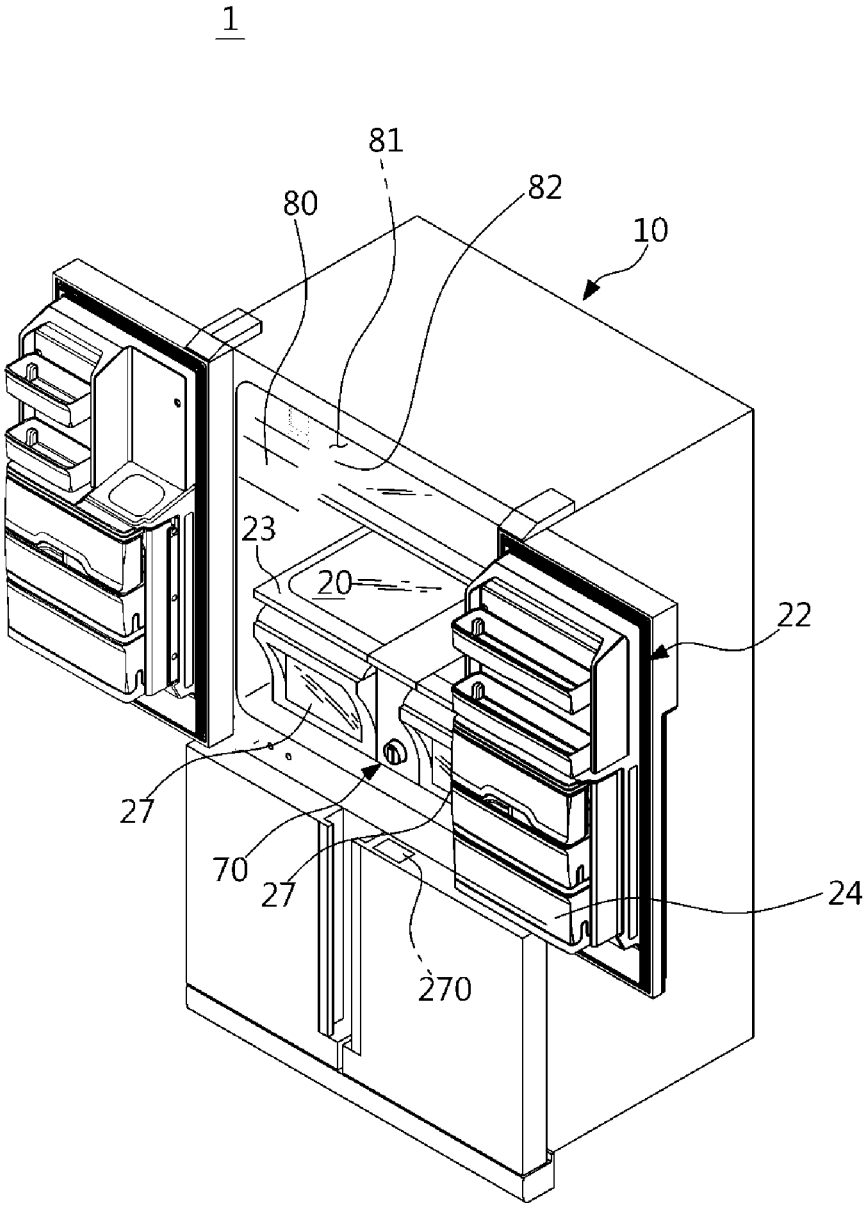
FIG. 2 is a perspective view illustrating a case in which an upper storage compartment of a refrigerator of FIG. 1 is opened.

FIG. 1 is a perspective view illustrating an exterior of a refrigerator according to an embodiment of the present disclosure, and FIG. 2 is a perspective view illustrating a case in which an upper storage compartment of a refrigerator of FIG. 1 is opened.

Referring to FIGS. 1 to 2, according to the embodiment of the present disclosure, a refrigerator 1 may include a body 10, a storage compartment 20 and 30 provided inside the body 10, and a cold air supplier (not shown) to supply cool air to the storage compartment 20 and 30.

The body 10 may include an inner case forming the storage compartment 20 and 30, an outer case forming an exterior of the refrigerator by being coupled to an outside of the inner case, and an insulator disposed between the inner and outer cases, to insulate the storage compartment 20 and 30.

The storage compartment 20 and 30 may be divided into an upper refrigerating compartment 20 and a lower freezing compartment 30 by an intermediate partition 11. The refrigerating compartment 20 may be kept at a temperature of approximately 3° C., to store food in a refrigerated state, whereas the freezing compartment 30 may be kept at a temperature of approximately −18.5° C., to store food in a frozen state. In the refrigerating compartment 20, racks 23 may be provided to place food thereon and at least one storage box 27 may also be provided to store food in a closed state.

In addition, an ice making compartment 81 to produce ice may be provided at an upper corner of the refrigerating compartment 20 to be separated from the refrigerating compartment 20 by an ice making compartment case 82. In the ice making compartment 81, an icemaker 80 may be provided, i.e. an ice making tray to produce ice, and an ice bucket to store ice produced in the ice making tray.

A water tank 70 capable of storing water may be provided at the refrigerating compartment 20. The water tank 70 may be disposed between a plurality of storage boxes 27, as illustrated in FIG. 2, but is not limited thereto. The water tank 70 may be disposed at any position, so long as it is disposed within the refrigerating compartment 20 in order to cool water stored in the water tank 70 by cold air in the refrigerating compartment 20.

Figure 8:
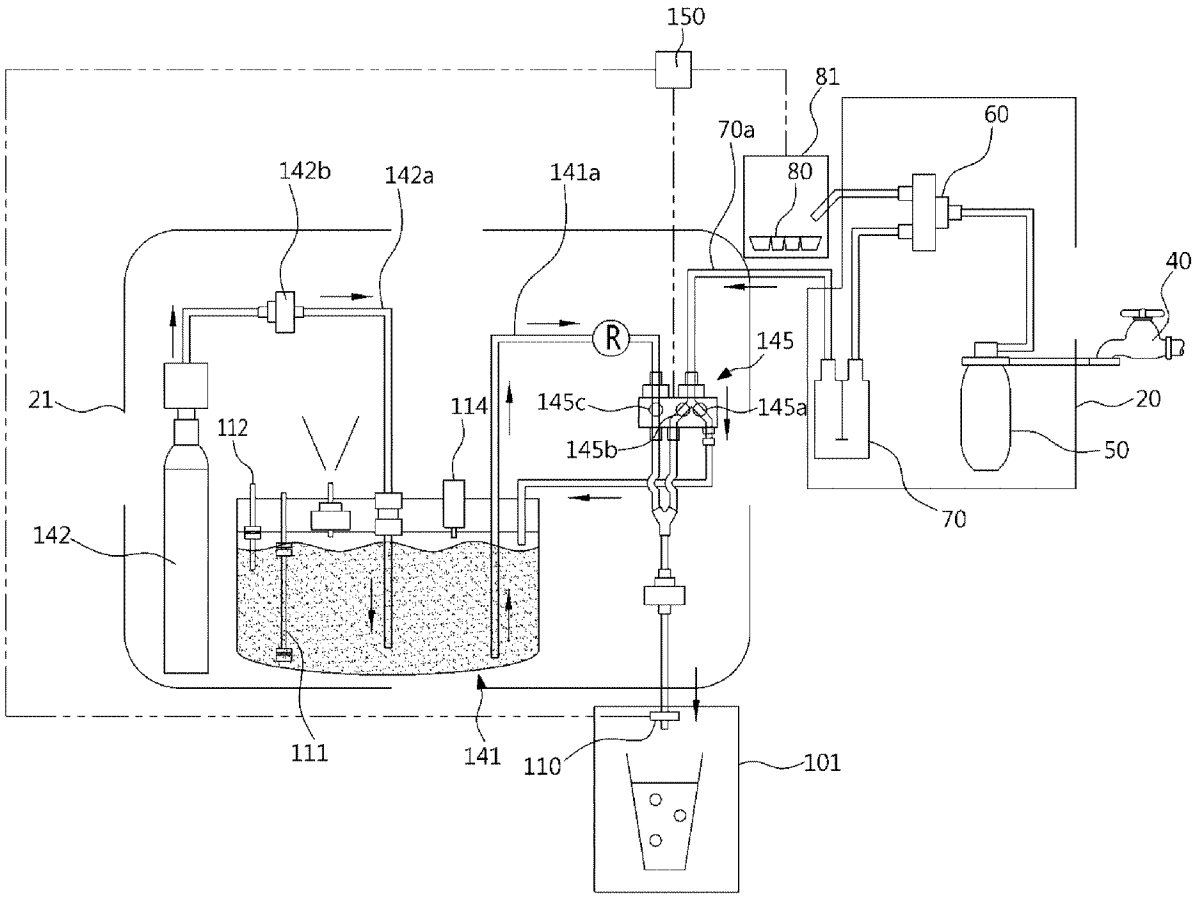
FIG. 8 is a schematic view illustrating a process in which a refrigerator of FIG. 1 produces water, ice, and carbonated water and supplies the water, ice, and carbonated water to a dispenser.

The water tank 70 may be connected to an external water supply source 40, e.g. a tap water (refer to FIG. 8) and may store purified water purified by a purification filter 50 (refer to FIG. 8). A flow path switching valve 60 may be provided at a water supply pipe configured to connect the water tank 70 to the external water supply source 40, and through the flow path switching valve 60, water may be supplied to the icemaker 80.

Each of the refrigerating compartment 20 and freezing compartment 30 has an open front side to allow food to be place therein or withdraw therefrom. The open front side of the refrigerating compartment 20 may be opened/closed by a pair of rotatable doors 21 and 22 hinge-coupled to the body 10. The open front side of the freezing compartment 30 may be opened/closed by a pair of rotatable doors 31 and 32 hinge-coupled to the body 10. Door guards 24 may be provided at rear surfaces of the refrigerating compartment doors 21 and 22 to store food.

A gasket (not shown) may be provided along an edge of the rear surface of the refrigerating compartment door 21 and 22 to confine cold air in the refrigerating compartment 20 by closing between the refrigerating compartment door 21 and 22 and the body 10 when the refrigerating compartment door 21 and 22 are closed. In addition, a rotating bar (not shown) may be selectively provided at one of the refrigerating compartment doors 21 and 22, to confine cold air in the refrigerating compartment 20 by closing between the refrigerating compartment door 21 and 22 when the refrigerating compartment door 21 and 22 are closed.

In addition, a dispenser 100 may be provided at one of the refrigerating compartment doors 21 and 22 to allow a user to put out water or ice from the outside without opening the refrigerating compartment door 21.

The dispenser 100 may include a dispensation space 101 in which a container such as a cup, is inserted to dispense water or ice; a control panel 102 in which an input button to operate a variety of settings of the dispenser 100 and a display to display a variety of information of the dispenser 100 are provided; and a lever unit 110 to operate the dispenser 100 to allow water, ice, carbonated water to be selectively discharged.

In addition, the dispenser 100 may include an ice chute 103 configured to connect the icemaker 80 to the dispensation space 101 so that ice generated in the icemaker 80 is discharged to the dispensation space 101.

The dispensation space 101 may be disposed on an outer surface of the refrigerating door 21. The ice chute 103 may be recessed from the refrigerating door 21 to the inside of the refrigerating door 21.

In an upper portion of the dispensation space 101, the ice chute 103 may be disposed. The ice chute 103 may connect the water tank 70, the icemaker 80, and a carbonated water production device 140 all of which are disposed inside of the 20 to the dispensation space 101, respectively. Therefore, the ice chute 103 may be provided as a path in which water, ice and carbonated water are moved from the inside of the 20 to the dispensation space 101.

Figure 3:
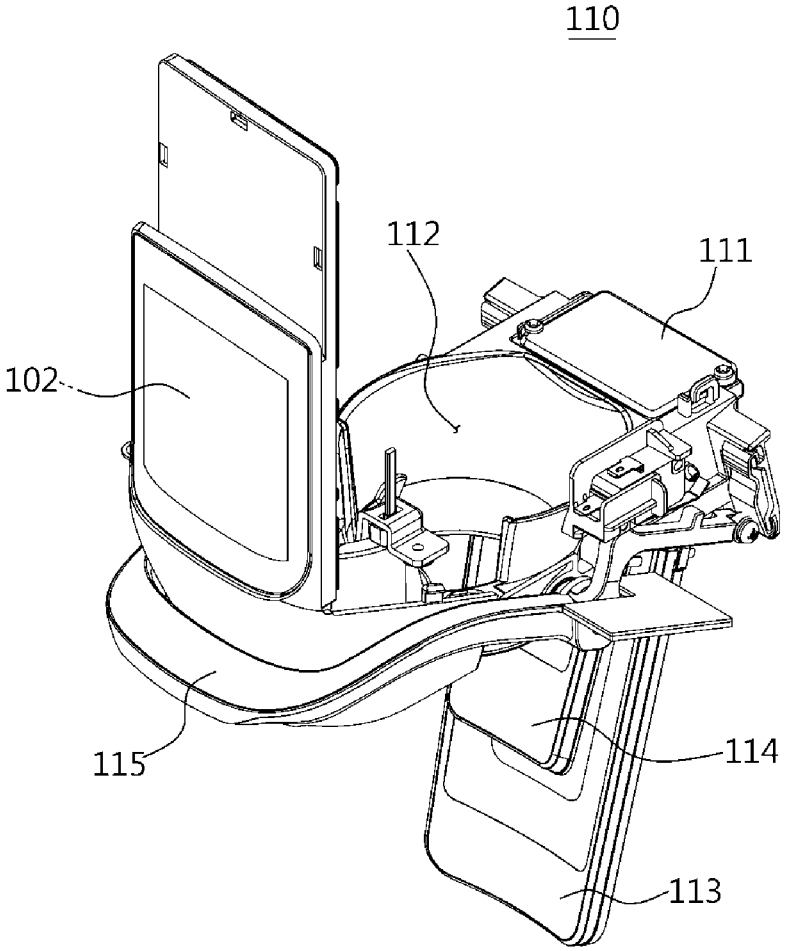
FIG. 3 is a perspective view illustrating a lever unit of FIG. 1 in accordance with an embodiment of the present disclosure.
Figure 4:
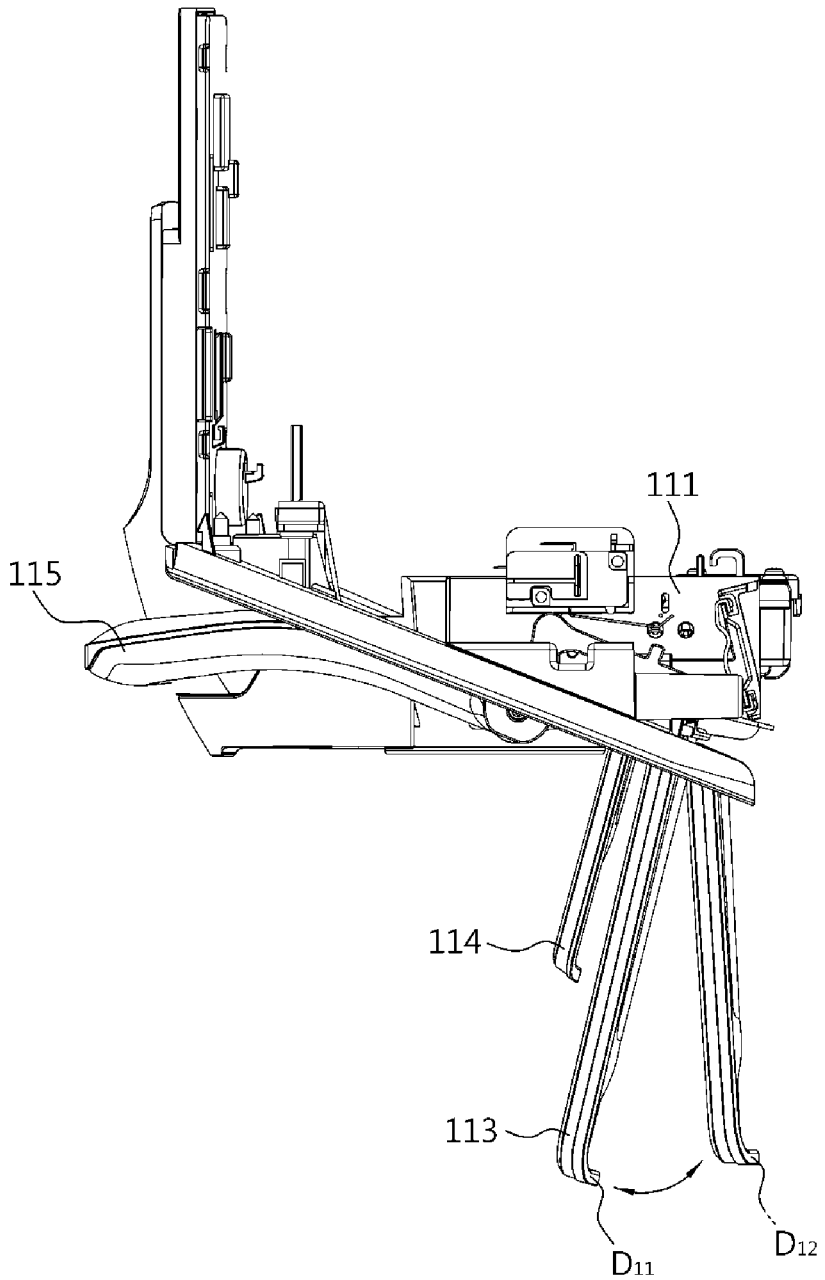
FIG. 4 is a lateral view illustrating an operation of a first lever of FIG. 3.
Figure 5:
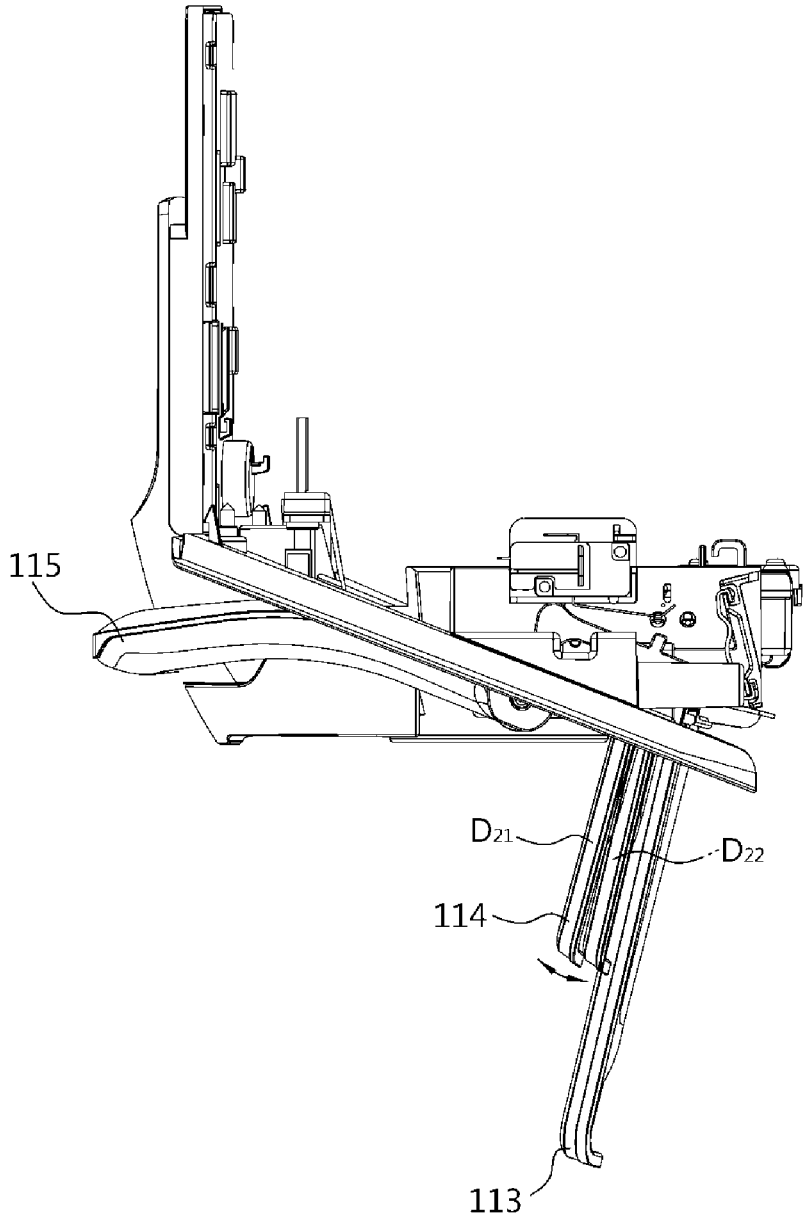
FIG. 5 is a lateral view illustrating an operation of a second lever of FIG. 3.
Figure 6:
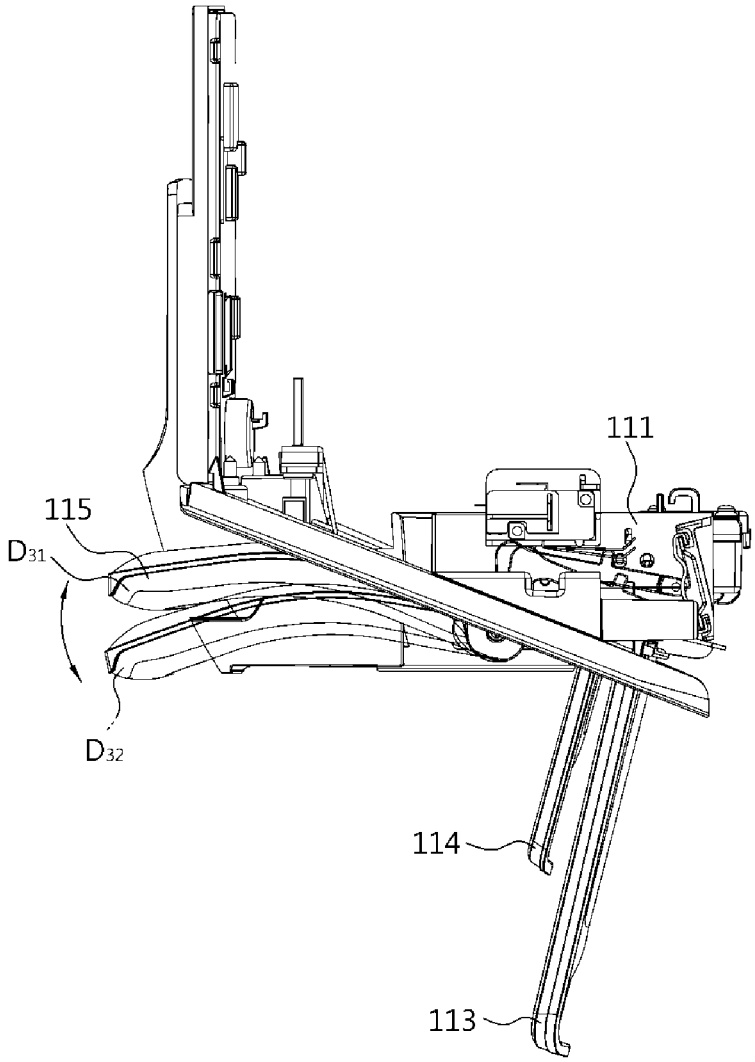
FIG. 6 is a lateral view illustrating an operation of a third lever of FIG. 3.

FIG. 3 is a perspective view illustrating a lever unit of FIG. 1 in accordance with an embodiment of the present disclosure, FIG. 4 is a lateral view illustrating an operation of a first lever of FIG. 3, FIG. 5 is a lateral view illustrating an operation of a second lever of FIG. 3, and FIG. 6 is a lateral view illustrating an operation of a third lever of FIG. 3.

Referring to FIGS. 3 to 6, according to the embodiment of the present disclosure, a lever unit 110 may include a lever unit body 111; an ice discharger 112; a first lever 113; a second lever 114 and a third lever 115.

The lever unit body 111 may be coupled to an upper surface of the dispenser 100. The lever unit body 111 may be provided such that one side of the first lever 113, one side of the second lever 114, and one side of the third lever 115 are coupled to each other. The lever unit body 111 may include a control panel 102 in which a display is provided in a front surface of the control panel. The control panel 102 including the display may display information of the refrigerator including a state of the dispenser 100. Alternatively, the control panel 102 including the display may be provided in another position besides the lever unit body 111.

The lever unit body 111 may include the ice discharger 112. The ice discharger 112 may be provided in the center portion of the lever unit body 111. The ice discharger 112 may play a role of a path in which water, ice and carbonated water are moved from the inside of the refrigerating compartment 20 to the dispensation space 101.

The first lever 113 may be disposed in the dispensation space 101. The first lever 113 may be installed such that one side of the first lever 113 is fixed to the lever unit body 111. An upper side of the first lever 113 that is fixed may be placed in a rear side of the ice discharger 112. The first lever 113 may be extended from the fixed upper portion to a lower side.

The first lever 113 may be provided to be rotatable with respect to the fixed upper portion. The first lever 113 may be rotatable from a first position (D11) to a second position (D12). The first position (D11) may be disposed in front of the second position (D12). The first lever 113 may include a restoration member (not shown). The restoration member (not shown) may move the first lever 113 that is disposed between the first position (D11) and the second position (D12) to the first position (D11). Accordingly, although a user moves the first lever 113 from the first position (D11), the first lever 113 may be returned to the first position (D11). The restoration member (not shown) may include an elastic member.

According to the embodiment, the first lever 113 may be electrically connected to a controller 150 (refer to FIG. 8). When the first lever 113 is moved to the first position (D11) or the second position (D12), the first lever 113 may transmit an electrical signal to the controller 150 (refer to FIG. 8). The controller 150 (refer to FIG. 8) may control the refrigerator 1 so that the refrigerator 1 performs a predetermined operation based on the variation of the position of the first lever 113.

The second lever 114 may be disposed in the dispensation space 101. The second lever 114 may be installed such that one side of the second lever 114 is fixed to the lever unit body 111. An upper side of the second lever 114 that is fixed may be placed in a rear side of the ice discharger 112. The second lever 114 may be disposed such that the fixed upper portion thereof is placed between the first lever 113 and the ice discharger 112. The second lever 114 may be extended from the fixed upper portion to a lower side. A lower end of the second lever 114 may be placed in a higher position than a lower end of the first lever 113. A length from the upper end to the lower end of the second lever 114 may be shorter than that of the first lever 113.

The second lever 114 may be provided to be rotatable with respect to the fixed upper end. The second lever 114 may be rotatable from a third position (D21) to a fourth position (D22). The third position (D21) may be disposed in front of the fourth position (D22). The second lever 114 may include a restoration member (not shown). The restoration member (not shown) may move the second lever 114 that is disposed between the third position (D21) and the fourth position (D22) to the third position (D21). Accordingly, although a user moves the second lever 114 from the third position (D21), the second lever 114 may be returned to the third position (D21). The restoration member (not shown) may include an elastic member.

According to the embodiment, the second lever 114 may be electrically connected to the controller 150 (refer to FIG. 8). Whenever the second lever 114 is moved to the third position (D21) or the fourth position (D22), the second lever 114 may transmit an electrical signal to the controller 150 (refer to FIG. 8). The controller 150 (refer to FIG. 8) may control the refrigerator 1 so that the refrigerator 1 performs a predetermined operation based on the variation of the position of the second lever 114.

The third lever 115 may be disposed in the dispensation space 101. The third lever 115 may have a shape of a letter U. The third lever 115 may be installed such that opposite ends of the third lever 115 are fixed to the same height. The opposite ends of the third lever 115 may be fixed to the lever unit body 111.

The third lever 115 may be provided to be rotatable with respect to the fixed opposite ends as an axis. The third lever 115 may be rotatable from a fifth position (D31) to a sixth position (D32). The fifth position (D31) may be disposed in a higher position than the sixth position (D32). The third lever 115 may be in a stationary state only when being placed in the fifth position (D31) and the sixth position (D32). When being escaped from the fifth position (D31), the third lever 115 may be automatically returned to the sixth position (D32). In addition, when being escaped from the sixth position (D32), the third lever 115 may be automatically returned to the fifth position (D31).

According to the embodiment, the third lever 115 may be electrically connected to the controller 150 (refer to FIG. 8). Whenever the third lever 115 is moved to the fifth position (D31) or the sixth position (D32), the third lever 115 may transmit an electrical signal to the controller 150 (refer to FIG. 8). The controller 150 (refer to FIG. 8) may control the refrigerator 1 so that the refrigerator 1 performs a predetermined operation based on the variation of the position of the third lever 115.

According to the embodiment of the present disclosure, the carbonated water production device 140 configured to produce carbonated water may be mounted to a rear surface of the refrigerating door 21 in which the dispenser 100 of the refrigerator 1 is disposed. In the inside of the refrigerator 1, the carbonated water production device 140 may produce carbonated water.

Figure 7:
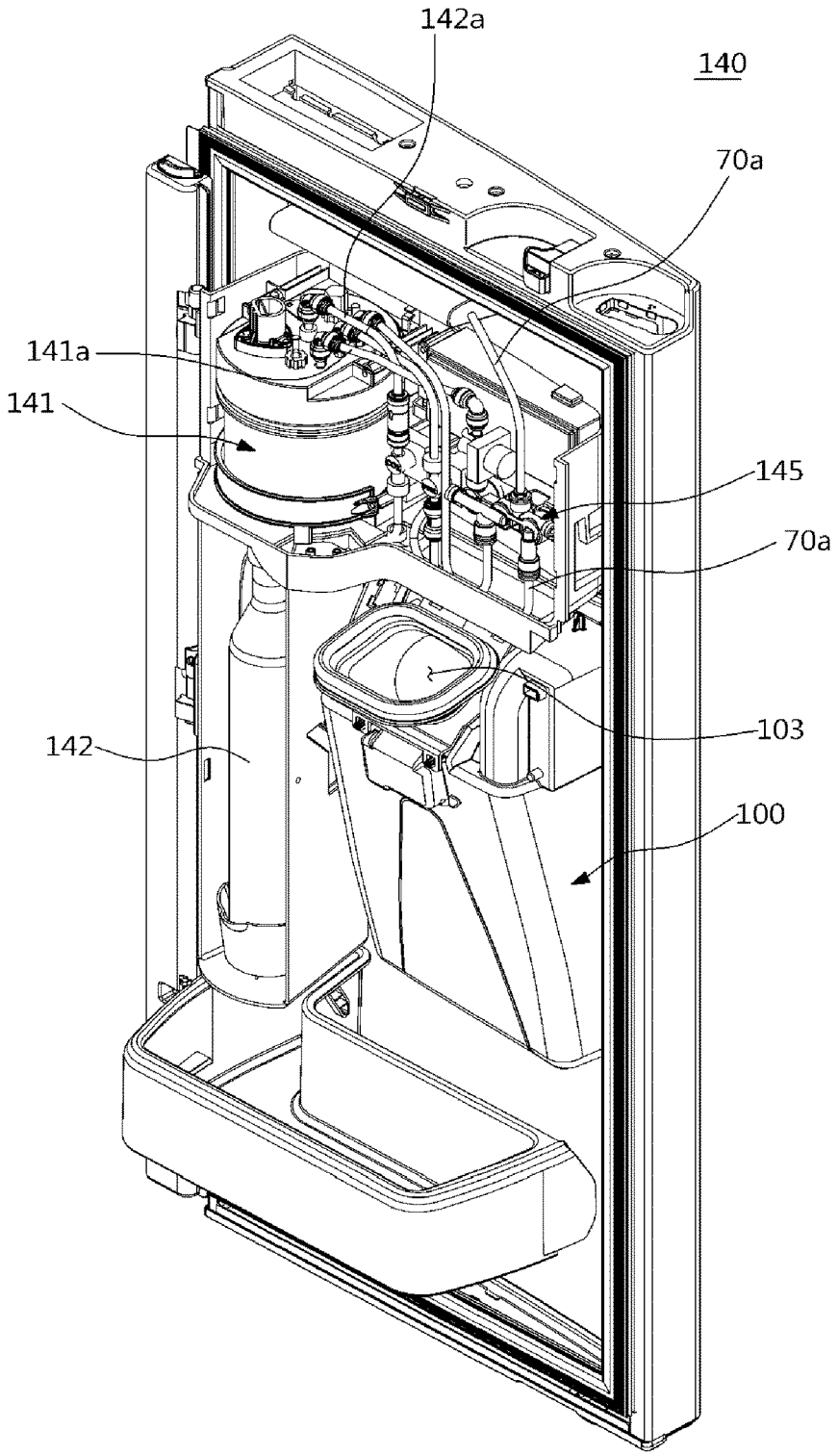
FIG. 7 is a perspective view illustrating a carbonated producing device of a refrigerator of FIG. 1.

FIG. 7 is a perspective view illustrating a carbonated producing device of a refrigerator of FIG. 1, and FIG. 8 is a schematic view illustrating a process in which a refrigerator of FIG. 1 produces water, ice, and carbonated water and supplies the water, ice, and carbonated water to a dispenser.

Referring to FIGS. 7 and 8, water is supplied from the external water supply source 40. The water may be moved from the external water supply source 40 to the purification filter 50 to be purified. The purified water may be moved from the purification filter 50 to the flow path switching valve 60. The flow path switching valve 60 may selectively move the purified water to the icemaker 80 and the water tank 70. An ice may be produced by water that is moved to the inside of the ice making compartment 81.

Water moved to the water tank 70 may be moved to a valve assembly 145 through a purified water supply flow path 70*a*. Purified water may be moved to a carbonated water tank 141 from the valve assembly 145 through a purified water supply valve 145*a* or moved to the dispensation space 101 of the dispenser 100 via a purified water discharge valve 145*b*. Water moved to the carbonated water tank 141 may combine with carbon dioxide gas that is moved to the carbonated water tank 141 through a separated flow path so as to produce carbonated water.

Carbon dioxide gas may be provided in the inside of a carbon dioxide gas cylinder 142. According to the embodiment, the carbon dioxide gas cylinder 142 may be replaceable. When carbon dioxide gas of the carbon dioxide gas cylinder 142 is run out, the carbon dioxide gas cylinder 142 may be replaced by another carbon dioxide gas cylinder 142 to supply carbon dioxide gas.

Carbon dioxide gas may be moved from the carbon dioxide gas cylinder 142 to the carbonated water tank 141 through a carbon dioxide gas supply flow path 142*a*. In the carbon dioxide gas supply flow path 142*a*, a carbon dioxide gas supply valve 142*b* may be provided. The carbon dioxide gas supply valve 142*b* may adjust an amount of carbon dioxide gas passing through the carbon dioxide gas supply flow path 142*a*. The carbon dioxide gas may be supplied to water stored in the carbonated water tank 141 through the carbon dioxide gas supply flow path 142*a*. Carbonated water may be produced by the above mentioned process.

The produced carbonated water may be moved to the valve assembly 145 through a carbonated water discharge flow path 141*a*. In the valve assembly 145, a carbonated water discharge valve 145*c* may control carbonated water that is to be supplied to the dispenser 100.

According to the embodiment, the controller 150 may be electrically connected to the lever unit 110, the valve assembly 145, and the icemaker 80. The lever unit 110 may transmit an operation signal of the first lever 113, the second lever 114, and the third lever 115 to the controller. The controller 150 may control whether to operate the valve assembly 145 and the icemaker 80 by using a signal transmitted from the lever unit 110.

The controller 150 may control the valve assembly 145 so that the valve assembly 145 adjusts the purified water discharge valve 145*b* and the carbonated water discharge valve 145*c* to allow carbonated water, purified water, and ice to be selectively discharged to the dispensation space 101.

According to the embodiment, the third lever 115 may adjust whether to discharge carbonated water. When the third lever 115 is placed in the fifth position (D31), the controller 150 may shut off the carbonated water discharge valve 145*c*. In this case, when the first lever 113 is moved to the second position (D12), the controller 150 may allow water to be moved to the dispensation space 101. When the second lever 114 is moved to the fourth position (D22), the controller 150 may allow ice to be moved to the dispensation space 101.

When the third lever 115 is placed in the sixth position (D32), the controller 150 may open the carbonated water discharge valve 145*c*. In this case, when the first lever 113 is moved to the second position (D12) or when the second lever 114 is moved to the fourth position (D22), the controller 150 may allow carbonated water to be moved to the dispensation space 101.

In contrast, in a state in which the third lever 115 is placed in the sixth position (D32), when the first lever 113 is moved to the second position (D12), the controller 150 may allow water to be moved to the dispensation space 101, and when the second lever 114 is moved to the fourth position (D22), the controller 150 may allow carbonated water to be moved to the dispensation space 101.

In addition, in a state in which the third lever 115 is placed in the sixth position (D32), when the first lever 113 is moved to the second position (D12), the controller 150 may allow carbonated water to be moved to the dispensation space 101, and when the second lever 114 is moved to the fourth position (D22), the controller 150 may allow ice to be moved to the dispensation space 101.

Figure 9:
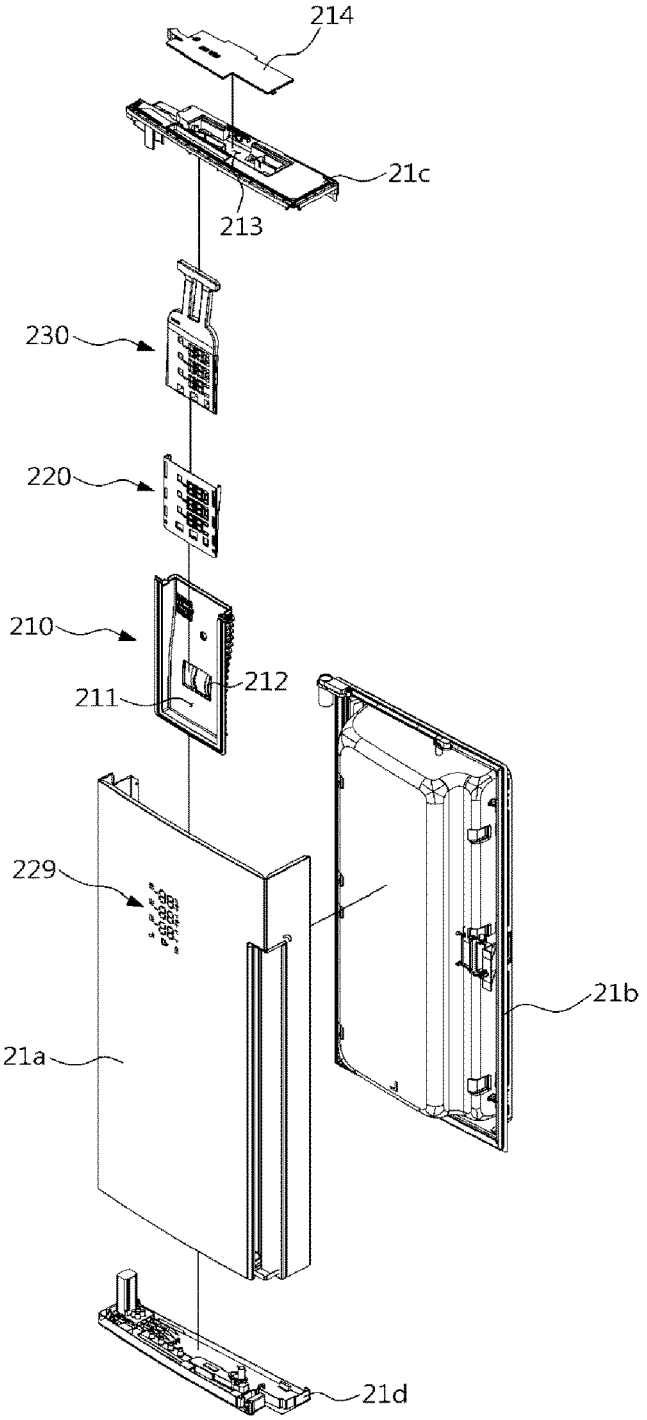
FIG. 9 is a schematic exploded perspective view illustrating a door assembly and a display assembly of a refrigerator of FIG. 1.
Figure 10:
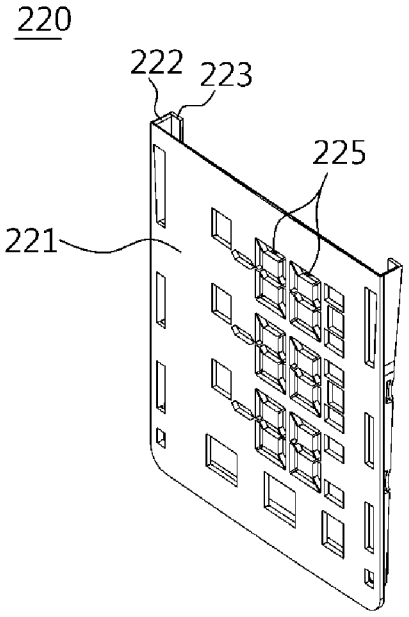
FIG. 10 is a perspective view illustrating a display housing of FIG. 9.
Figure 11:
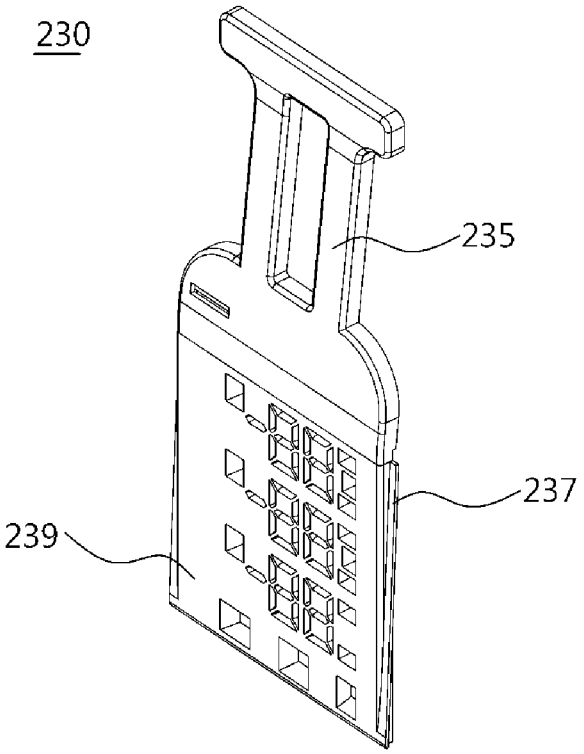
FIG. 11 is a perspective view illustrating a display unit of FIG. 9.
Figure 12:
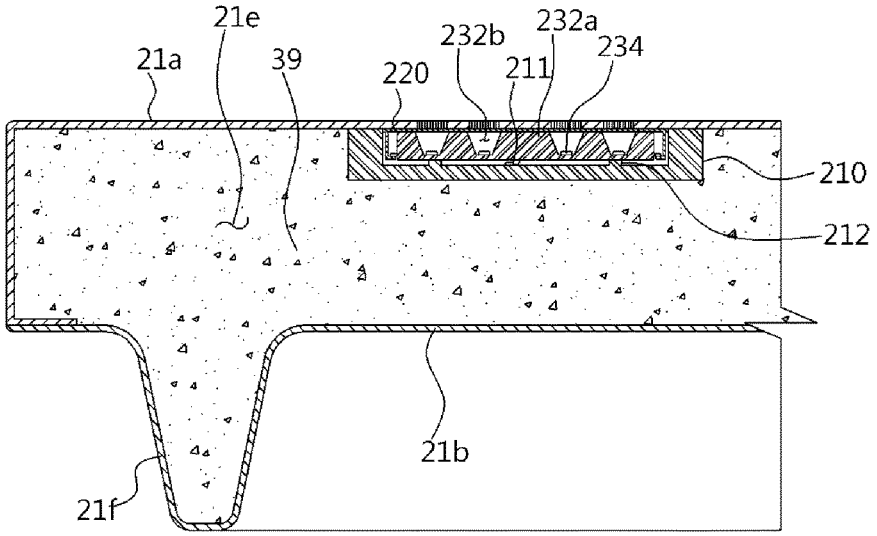
FIG. 12 is a cross-sectional view illustrating a door of a refrigerator of FIG. 9.

FIG. 9 is a schematic exploded perspective view illustrating a door assembly and a display assembly of a refrigerator of FIG. 1, FIG. 10 is a perspective view illustrating a display housing of FIG. 9, FIG. 11 is a perspective view illustrating a display unit of FIG. 9, and FIG. 12 is a cross-sectional view illustrating a door of a refrigerator of FIG. 9.

Referring to FIGS. 9 to 12, the door 21 may be formed such that a front panel 21*a* forming a front surface and an opposite side surface of the door 21, a rear panel 21*b* forming a rear surface of the door 21, and a top cap 21*c* and a bottom cap 21*d* closing an upper end and a lower end of an inner space formed between the front panel 21*a* and the rear panel 21*b* are coupled to each other.

The front panel 21*a* may be formed of metal material, e.g. steel, aluminum, alloy, PCM, and VCM. The front panel 21*a* may be formed such that a single panel is bent to form the front surface and the opposite side surfaces of the door 21.

Due to characteristics of metal material, the front panel 21*a* may have a higher strength than a tempered glass plate or a resin plate, and may provide a sense of luxury. The front panel 21*a* may improve the aesthetic sense due to metal-specific-surface treatment.

On a surface of the front panel 21*a*, a hair line processing, a mirror polished processing or a bead blast processing may be performed. In this case, any one of those processing may be performed on the front panel 21*a*.

Alternatively, all of the plurality of processing may be performed on the front panel 21*a*. That is, the front panel 21*a* may have all of hair line pattern, gloss, and bead. In this case, the mirror polished processing, the hair line processing, and the hair line processing may be performed in order.

The rear panel 21*b* may be vacuum-molded of a resin material. The rear panel 21*b* may have a dyke 21*f* protruding toward a rear side to allow a door guard to be mounted.

The top cap 21*c* and the bottom cap 21*d* may be injection molded of a resin material. After the front panel 21*a*, the rear panel 21*b*, the top cap 21*c* and the bottom cap 21*d* are coupled to each other to form an inner space, an insulation foaming agent may be injected into or foam in the inner space.

That is, a foam space 21*e* in which an insulating material 39 is foamed may be formed between the front panel 21*a* and the rear panel 21*b*. Urethane may be uses as the insulating material 39 to insulate the storage compartment 20. When the insulation foaming agent completely foams in the foam space 21*e*, the front panel 21*a*, the rear panel 21*b*, the top cap 21*c* and the bottom cap 21*d* may be strongly coupled to each other by an adhesive force of the foaming agent.

In the inside of the door 21, a display assembly 200 may be provided. The display assembly 200 may display information related to an operation of the refrigerator or may receive an input of an operation command of the refrigerator.

According to an embodiment, the display assembly 200 may include a display housing 210; a display guide unit 220; a display unit 230; and an input member 270.

The display housing 210 may have an opened front side and an upper side. The display housing 210 may be installed in the inside of the door 21 to be fixed to an upper portion of the rear surface of the front panel 21*a*.

An accommodation space 211 may be provided in the inside of the display housing 210. The accommodation space 211 may be formed in front side of the display housing 210 to have a groove shape. The accommodation space 211 may provide a space in which the display guide unit 220 and the display unit 230 are accommodated.

In the accommodation space 211, a fixation protrusion 212 may be provided to fix the display unit 230 by pressing the display unit 230 toward the front side. The fixation protrusion 212 may be disposed in the rear side of the display housing 210. The fixation protrusion 212 may be protruded toward the front side from the display housing 210. The fixation protrusion 212 may have a gentle curved surface to guide a movement of the display unit 230 that is inserted from an upper side to a lower side. The fixation protrusion 212 may be formed of an elastic material having the elastic force.

The display guide unit 220 may be installed in the inside of the display housing 210. The display guide unit 220 may include a guide unit front panel 221; a guide unit side panel 222; and a guide supporting unit 223. The display guide unit 220 may guide the display unit 230 that is described later so that the display unit 230 is closely attached to the rear surface of the front panel 21*a*.

The guide unit front panel 221 may have a shape that is identical to the front side of the display unit 230. The guide unit side panel 222 may be extended from the opposite sides of the guide unit front panel 221 to the rear side. The guide supporting unit 223 may be bent from one end of the guide unit side panel 222 to the inner side.

According to the embodiment, as the guide unit side panel 222 becomes near to the lower portion thereof, a length extended from the guide unit front panel 221 may be reduced. When seen from a side view, the guide unit side panel 222 may have a diagonal shape.

The display unit 230 may include a display guide member 237 in a lateral side thereof. The display guide member 237 may be extended from opposite sides of the display unit 230. According to the embodiment, one end of the display guide member 237 may be disposed on a front side of a lower end of the opposite sides of the display unit 230 and the other end of the display guide member 237 may be disposed on a rear side of an upper end of the opposite sides of the display unit 230. The display guide member 237 may be diagonally extended from a front side of a lower end of a side surface to a rear side of an upper end of the display unit 230.

Since it is required to prevent the insulation foaming agent from being permeated to the accommodation space 211, when the insulation foaming agent is injected into or foams in the foam space 21*e*, the top cap 21*c* may be disposed to allow the front side of the display housing 210 to be closely attached to the rear surface of the front panel 21*a*.

Since the display housing 210 is closely attached to the rear surface of the front panel 21*a*, the accommodation space 211 formed in the inside of the display housing 210 may be separated from the foam space 21*e*. That is, four sides of up, down, left and right, and a lateral side and a rear side of the accommodation space 211 may be covered by the display housing 210, and the front side of the accommodation space 211 may be covered by the rear surface of the front panel 21*a*.

Although not shown, a sealing member may be provided in the front surface of the display housing 210 to secure the closeness of the accommodation space 211 and the foam space 21*e*. The sealing member may include an elastic material, e.g. rubber or an adhesive material, e.g. tape.

The top cap 21*c* may further include a cover 214 to enclose a top cap insertion hole 213 after the display unit 230 or the guide unit 220 is inserted into the accommodation space 211 of the display assembly 200 through the top cap insertion hole 213.

By using the structure, the display assembly 200 may be mounted to the inside of the door 21, and the display assembly 200 may be not exposed to the outside. However, when certain information is displayed on the display assembly 200, the information may be displayed to the outside through a plurality of through holes 229 of the front panel 21*a*.

Figure 13:
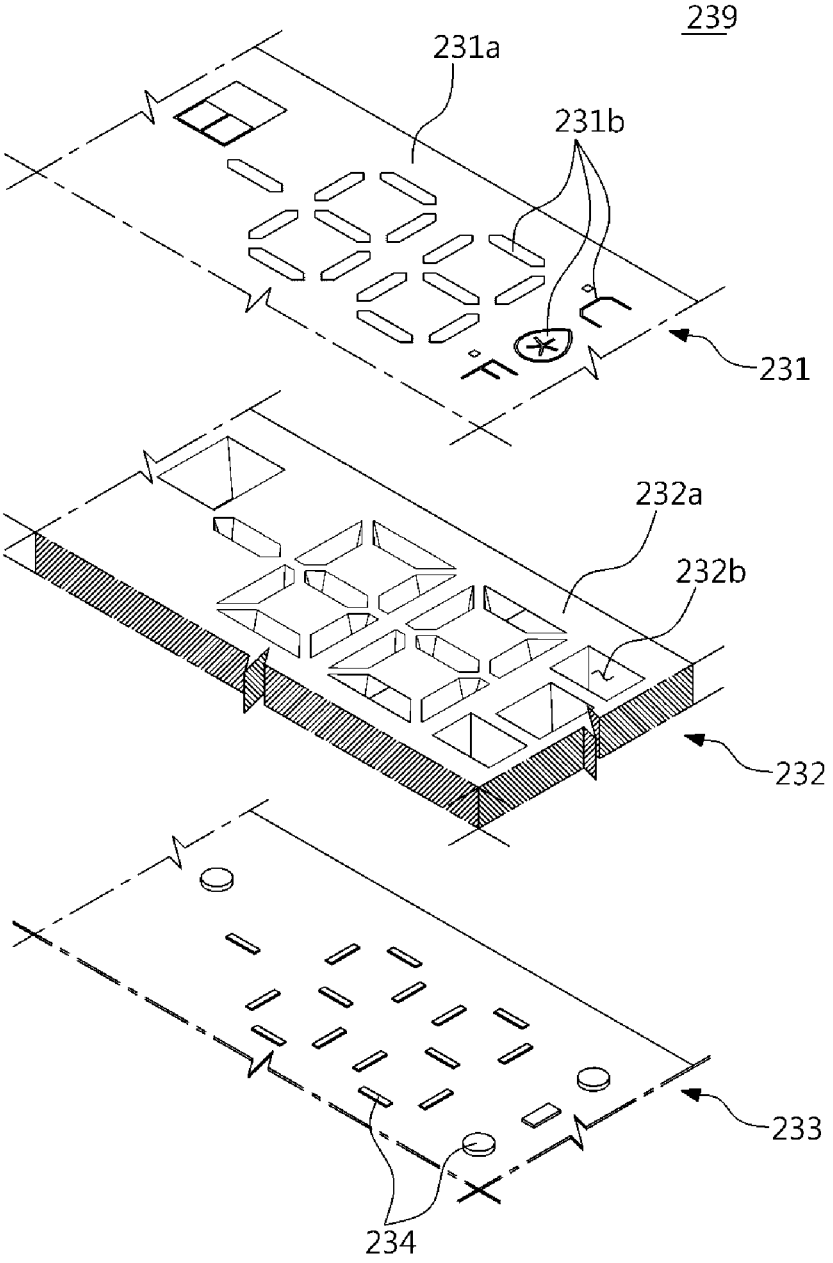
FIG. 13 is an exploded view illustrating a display unit of a refrigerator of FIG. 9.

FIG. 13 is an exploded view illustrating a display unit of a refrigerator of FIG. 9.

Referring to FIG. 13, the display unit 230 may include a cover sheet 231; a light source 233 configured to emit a light; and a guide unit 232 configured to guide a light emitted from the light source 233 to a display 231*b*.

The cover sheet 231 may include the display 231*b* configured to display information by becoming brighter or darker and a supporting unit 231*a* kept in a relatively dark state. The display 231*b* may be formed of transparent material or fluorescent material and the supporting unit 231*a* may be formed of opaque material.

The cover sheet 231 may be provided separately from the guide unit 232 and may be attached to one side of the guide unit 232.

The display 231*b* may be configured with any one or a combination of a picture, a character, a number and a symbol, and a segment forming a part of those. Therefore, when a light illuminates the cover sheet 231, a picture, a character, a number and a symbol of the display 231*b* may be brightened to display operation information of the refrigerator.

The light source 233 may include a light emitting diode (LED) 234 configured to emit a light. A plurality of the LED 234 may be provided and may be individually controlled.

The guide unit 232 may guide a light emitted from the LED 234 toward the cover sheet 231. The guide unit 232 may include a guide body unit 232*a* formed of material reflecting a light and a guide hole 232*b* configured to penetrate the guide body unit 232*a*. The guide hole 232*b* may have a size being gradually increased from a side of the LED 234 to a side of the cover sheet 231, as illustrated in FIG. 12.

Figure 14:
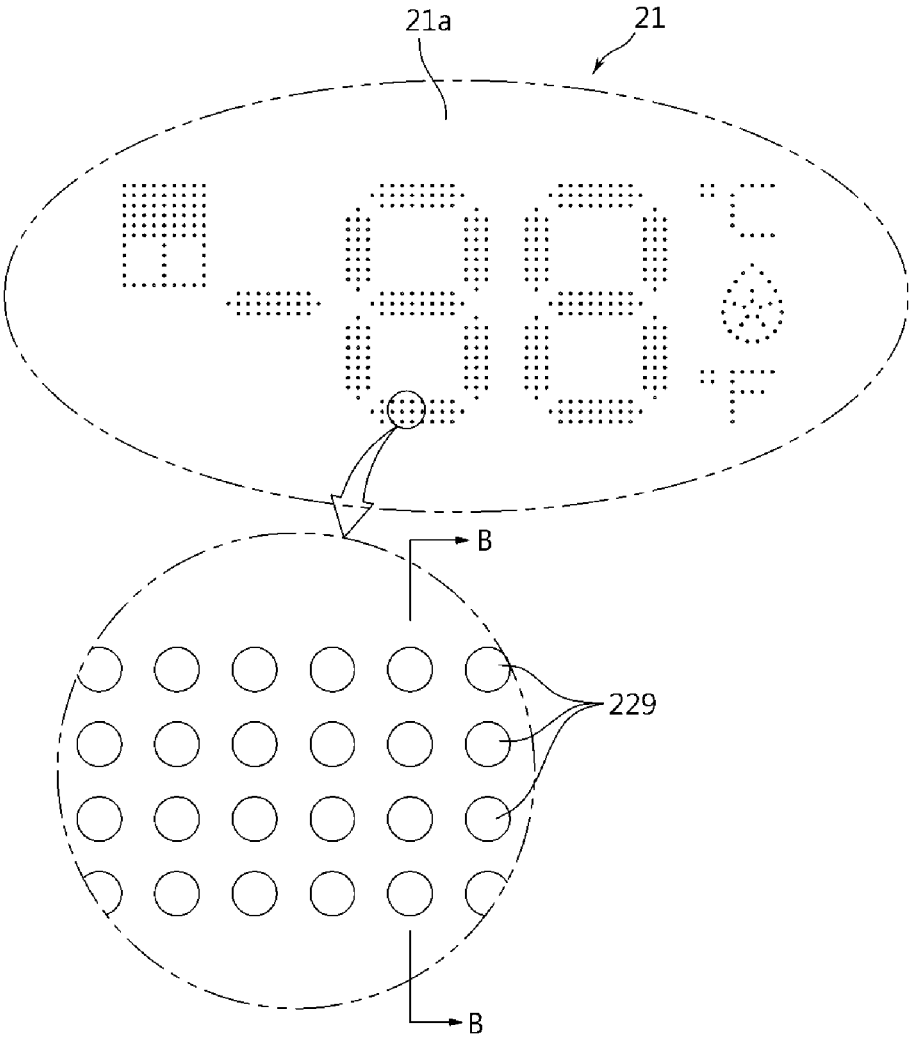
FIG. 14 is an enlarged view illustrating a surrounding of through holes of a front panel of a refrigerator of FIG. 9.
Figure 15:
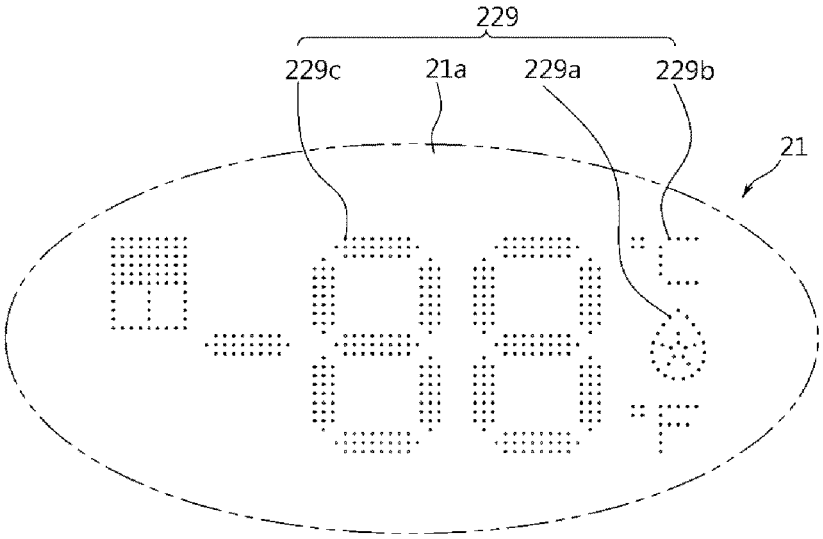
FIG. 15 is an enlarged view illustrating a surrounding of through holes of a front panel when a display unit of a refrigerator of FIG. 9 is turned off.
Figure 16:
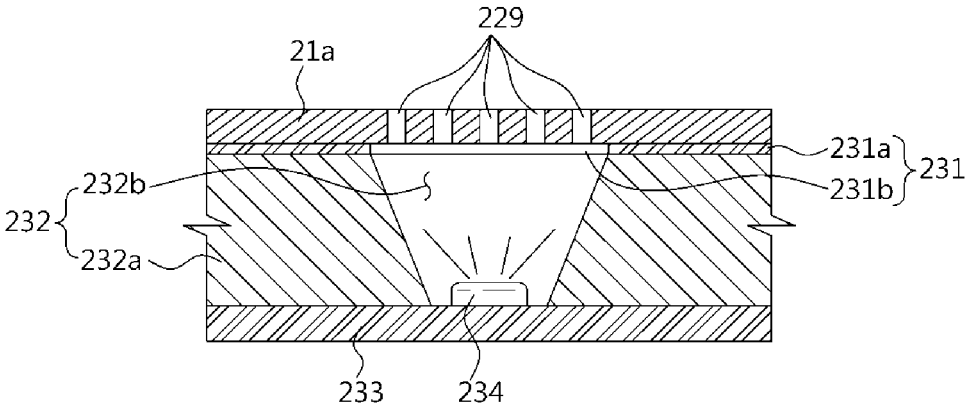
FIG. 16 is a cross-sectional view taken along line B-B' of FIG. 14.

FIG. 14 is an enlarged view illustrating a surrounding of through holes of a front panel of a refrigerator of FIG. 9, and FIG. 15 is an enlarged view illustrating a surrounding of through holes of a front panel when a display unit of a refrigerator of FIG. 9 is turned off, and FIG. 16 is a cross-sectional view taken along line B-B' of FIG. 14.

Referring to FIGS. 14 to 16, when the display assembly 200 that is hidden in the inside of the door 21 displays certain information, the information may be displayed through the plurality of the through holes 229 of the front panel 21*a* of the door 21, as illustrated in FIG. 14.

The through holes 229 formed in the front panel 21*a* may have a diameter of approximately 0.1 mm to 0.5 mm, and a distance between the through holes 229 may be approximately 0.3 mm to 1.5 mm. The through holes 229 may be observed with naked eyes of a user. At this time, it is assumed that the thickness of the front panel 21*a* is 0.6 mm or less.

The through holes 229 may be formed through an etching or a laser drilling. When the size of the through-holes 229 is determined as a range of 0.3 mm~0.4 mm, the etching having a high degree of accuracy may be appropriate.

When the size of the through-hole 229 is less than 0.2 mm, it may be appropriate to use the laser drilling process although there may be some thermal deformation or burr. Meanwhile, in a state of a relatively small shape, when the size of the through-hole 229 is large, the discrimination may be reduced and thus it may be appropriate that the size of the through-hole 229 is less than 0.2 mm.

That is, the through holes 229 may be arranged to form a shape of a picture 229*a*, a character 229*b* and a segment of numbers 229*c* corresponding a picture, a character, and a segment of numbers of the display 231*b*, respectively. Therefore, when the LED 234 emits light to display a certain picture, character, number, and symbol on the display assembly 200, the certain picture, character, number, and symbol may be displayed on the front panel 21*a* of the door.

Figure 17:
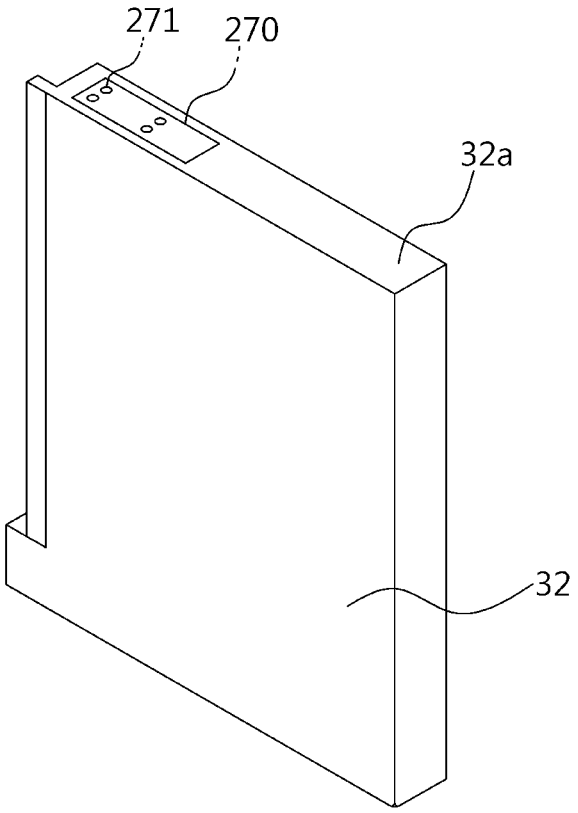
FIG. 17 is a view illustrating an input member of a display assembly of FIG. 9.

FIG. 17 is a view illustrating an input member of a display assembly of FIG. 9.

Referring to FIG. 17, according to the embodiment of the present disclosure, the display unit may be provided such that the input member 270 is separated from the display unit 230. The display unit 230 may be placed in a position in the door 21 to allow a user to easily view. As mentioned above, the display unit 230 may be disposed in an upper portion of the inside of the upper door 21.

According to the embodiment, the input member 270 may be disposed in a door that is different from a door in which the display unit 230 is disposed. The input member 270 may be disposed in the inside of a top cap 32*a* of the lower door 32.

The input member 270 may receive an input of an operation command of the refrigerator. The input member 270 may be provided as a capacitive touch sensing sensor.

For example, the input member 270 may have a sensor (not shown) configured to measure the change in the electric charge corresponding to a users touch.

When a user touches a certain area corresponding to a position of a touch button 271, a sensor may sense whether to be touched by measuring the change of the electric charge flowing in the touch button 271. The input member 270 may employ a well-known method, e.g. a resistive method, a dome switch method, a proximity sensing (IR) method as well as a capacitive method.

As described above, a method in which the through holes 229 is formed on the front panel 21*a* of the door 21 and the display unit 230 is hidden by being disposed in the inside of the door 21 may be applied to kitchen appliances such as cooking apparatus, as well as a refrigerator.

Figure 18:
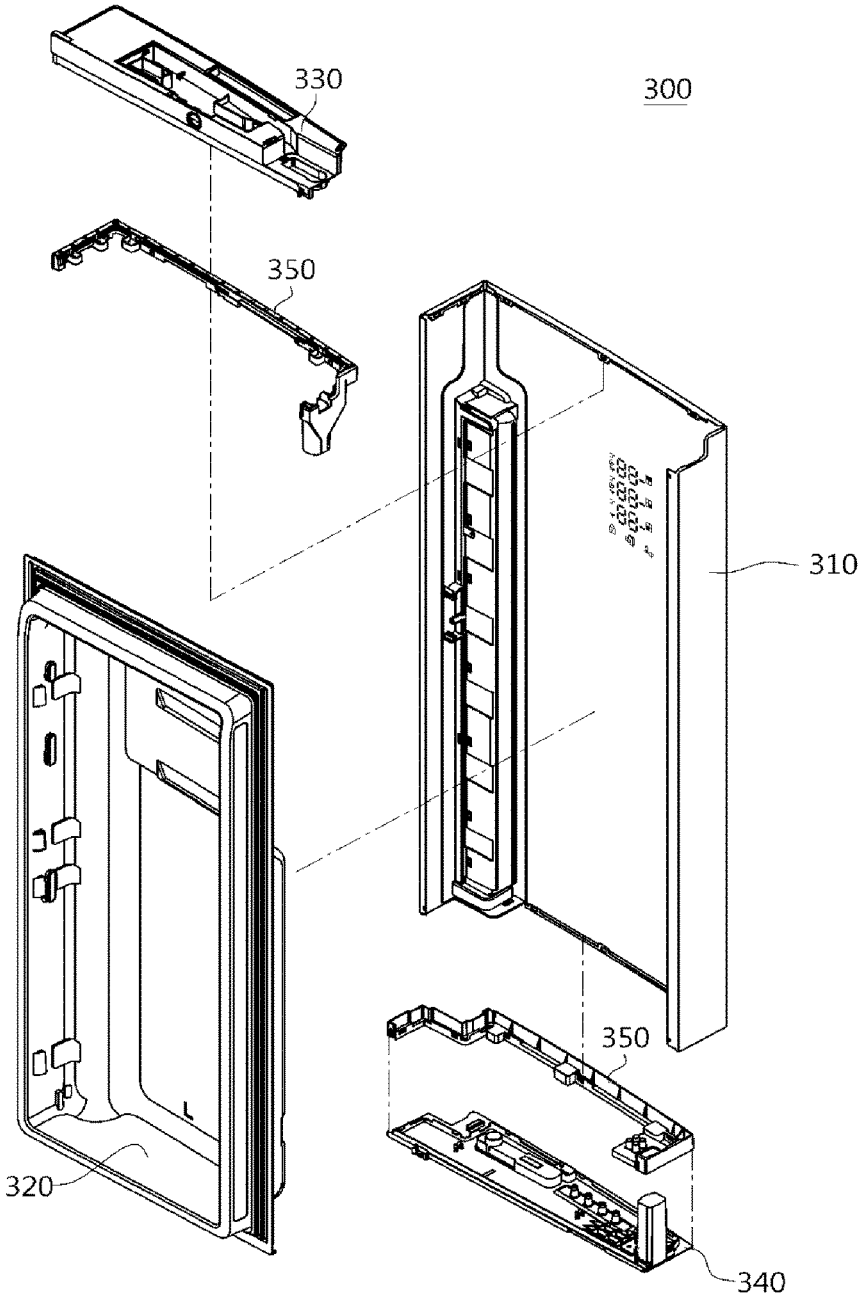
FIG. 18 is a schematic exploded perspective view illustrating a door assembly of a refrigerator of FIG. 1.
Figure 19:
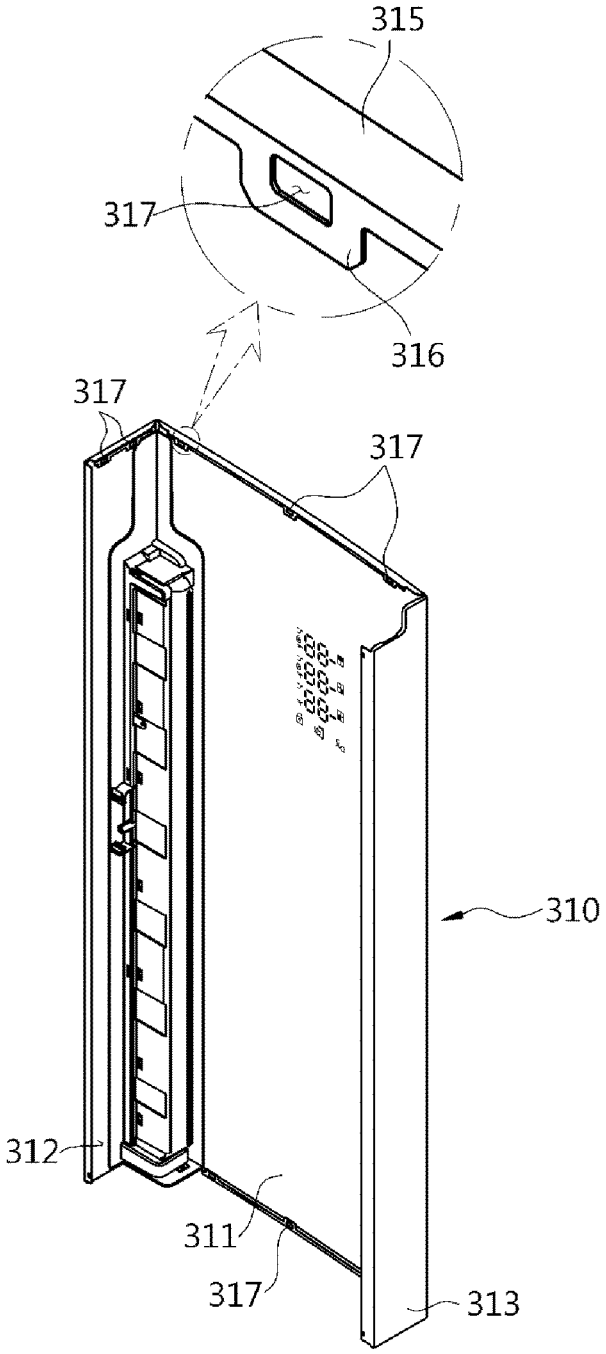
FIG. 19 is a perspective view illustrating an inner side of a front panel of a door assembly of FIG. 18.

FIG. 18 is a schematic exploded perspective view illustrating a door assembly of a refrigerator of FIG. 1, and FIG. 19 is a perspective view illustrating an inner side of a front panel of a door assembly of FIG. 18.

Referring to FIGS. 18 and 19, according to the embodiment of the present disclosure, a door assembly 300 may include a front panel 310, a rear panel 320, and a door cap 330 and 340.

The front panel 310 may form a front and both sides of the door assembly 300. The front panel 310 may be formed of metal material, e.g. steel, aluminum, alloy, PCM, and VCM. The front panel 310 may be formed such that a single panel is bent to form a front side 311 and both sides 312 and 313 of the door assembly 300.

As illustrated in FIG. 19, the front panel 310 may include a first coupling unit 315 extended from an upper end toward the inner side of the door assembly 300 and a second coupling unit 316 extended from one side of the first coupling unit 315 toward a lower side. The first coupling unit 315 and the second coupling unit 316 may be formed such that a single panel is bent.

The front panel 310 may include a first coupling hole 317. A first locking unit 353 of a connection member 350 described later may be inserted into the first coupling hole 317. Accordingly, the front panel 310 and the connection member 350 may be coupled to each other.

The first coupling hole 317 may be provided in the second coupling unit 316. The first coupling hole 317 may be provided in plural. A plurality of the first coupling hole 317 may be provided in the second coupling unit 316 with a certain gap. The first coupling hole 317 may be provided in the front side 311 and the both sides 312 and 313 of the front panel 310.

The first coupling unit 315, the second coupling unit 316, and the first coupling hole 317 may be provided on a lower end of the front panel 310. The first coupling unit, the second coupling unit and the first coupling hole, all of which are provided in the lower end of the front panel 310, may be coupled to the connection member 350 coupled to the bottom cap 340.

Referring to FIG. 18 again, the rear panel 320 may be coupled to a rear surface of the front panel 310 to form a rear side of the door assembly 300. The rear panel 320 may be coupled to the front panel 310 while being apart from a rear side of the front panel 310 by a certain distance. The rear panel 320 may form an inner space by being coupled to a rear end of the both sides 312 and 313 of the front panel 310.

The rear panel 320 may be vacuum-molded of a resin material. The rear panel 320 may have a dyke (not shown) protruding toward a rear side to allow a door guard to be mounted.

Figure 20:
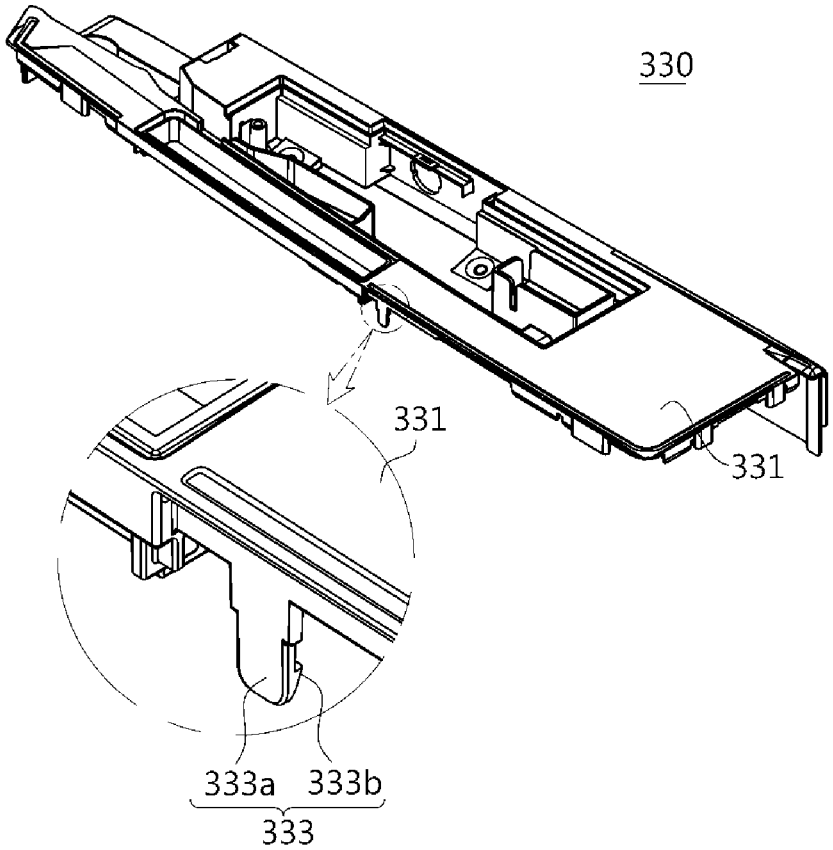
FIG. 20 is a perspective view illustrating a door cap of a door assembly of FIG. 18.

FIG. 20 is a perspective view illustrating a door cap of a door assembly of FIG. 18.

Referring to FIGS. 18 to 20, the door cap 330 and 340 may cover an upper side and a lower side of the door assembly 300. The door cap 330 and 340 may respectively close an upper end and a lower end of an inner space, formed by the front panel 310 and the rear panel 320. The door cap 330 and 340 may be injection molded of a resin material.

The door cap 330 and 340 may include a top cap 330 configured to cover an upper side of the door assembly 300 and a bottom cap 340 configured to cover a lower side of the door assembly 300. The top cap 330 and the bottom cap 340 may have a shape symmetrical to each other. In addition, the top cap 330 may have the same configuration as the bottom cap 340. Hereinafter the top cap 330 will be described as an example, and a description of the bottom cap 340 will be omitted.

The top cap 330 may be coupled to one side of an upper portion of the front panel 310. The top cap 330 may include a door cap coupling member 333 disposed in one side of the top cap 330 and configured to couple the top cap 330 with the connection member 350.

The door cap coupling member 333 may be extended from the lower surface of the top cap 330 to an inner side direction of the door assembly 300. The door cap coupling member 333 may be coupled to the connection member 350 described later. Accordingly, the door cap coupling member 333 may couple the top cap 330 to the connection member 350.

The door cap coupling member 333 may include a coupling member body 333*a* and a coupling member protrusion 333*b*. The coupling member body 333*a* may be extended from the lower surface of the top cap 330 to a lower side. The coupling member body 333*a* may be extended to have a length that is longer than a deep of a second groove 356 so that the coupling member body 333*a* is passed through a second coupling hole 357 provided in the inside of the second groove 356.

The coupling member protrusion 333*b* may be provided in one side of a lower portion of the coupling member body 333*a*. The coupling member protrusion 333*b* may be protruded vertically to a longitudinal direction of the coupling member body 333*a*. The coupling member protrusion 333*b* may be locked with the second coupling hole 357. By the structure, the door cap coupling member 333 may be coupled to the connection member 350.

In a state in which the top cap 330 is coupled to the connection member 350 described later, the upper side of the top cap 330 may be placed in the same height as the upper side of the front panel 310. In a state in which the top cap 330 is coupled to the connection member 350 described later, the front side of the top cap 330 may be provided to face the second coupling unit 316 of the front panel 310.

Hereinafter according to the embodiment of the present disclosure, the connection member 350 of the door assembly 300 will be described in details.

Figure 21:
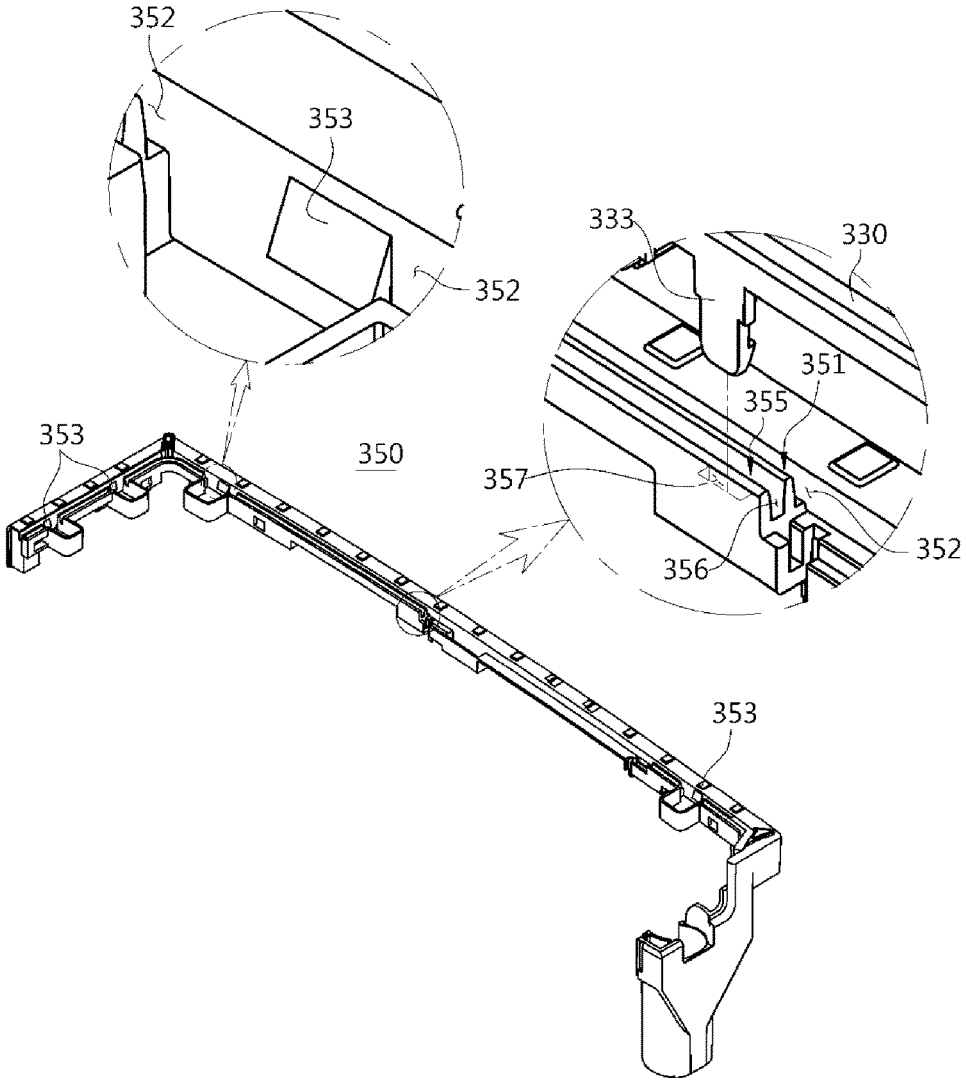
FIG. 21 is a perspective view illustrating a connection member of a door assembly of FIG. 18.
Figure 22A:
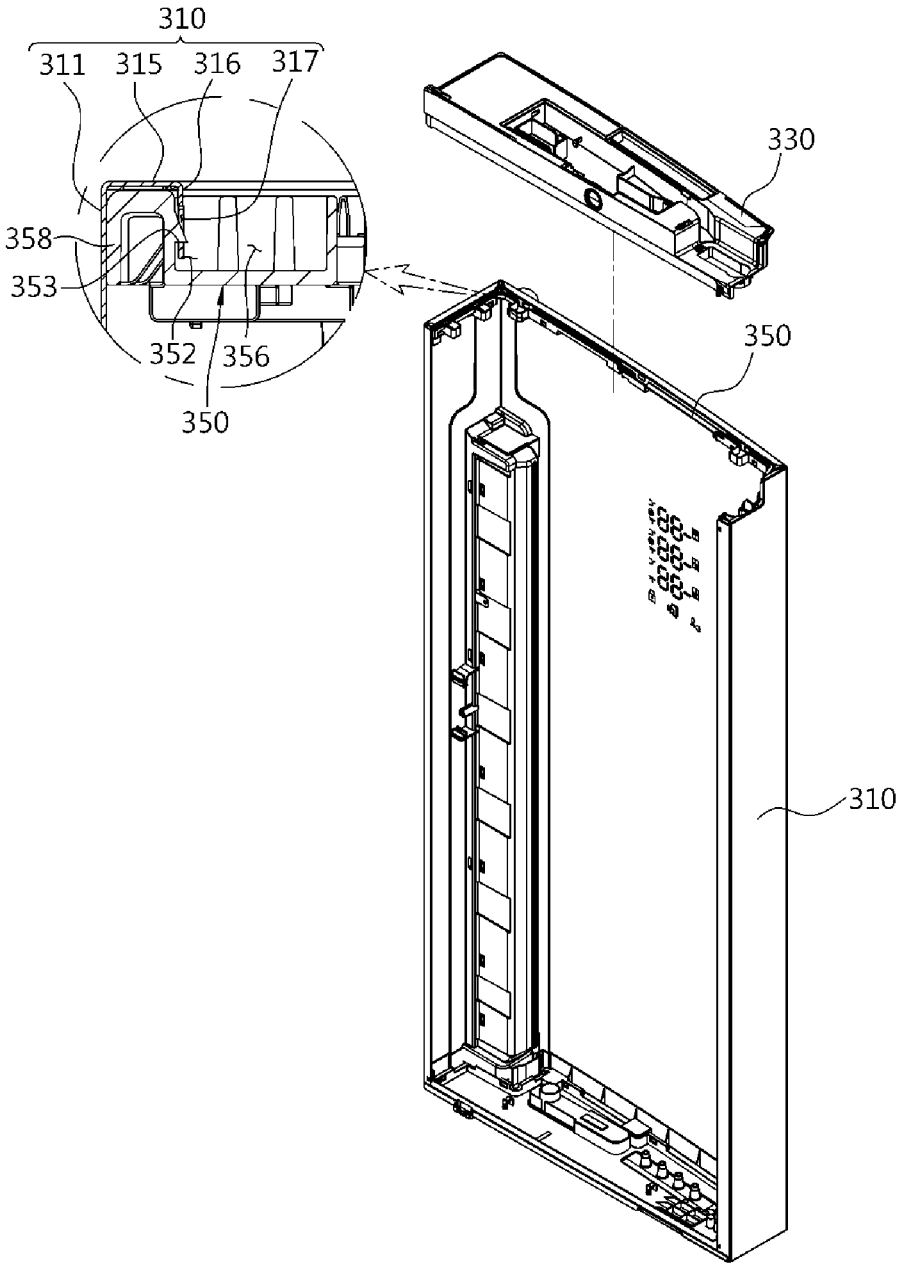
FIG. 22A is a view illustrating a state in which a front panel of a door assembly of FIG. 18 is coupled to a connection member.
Figure 22B:
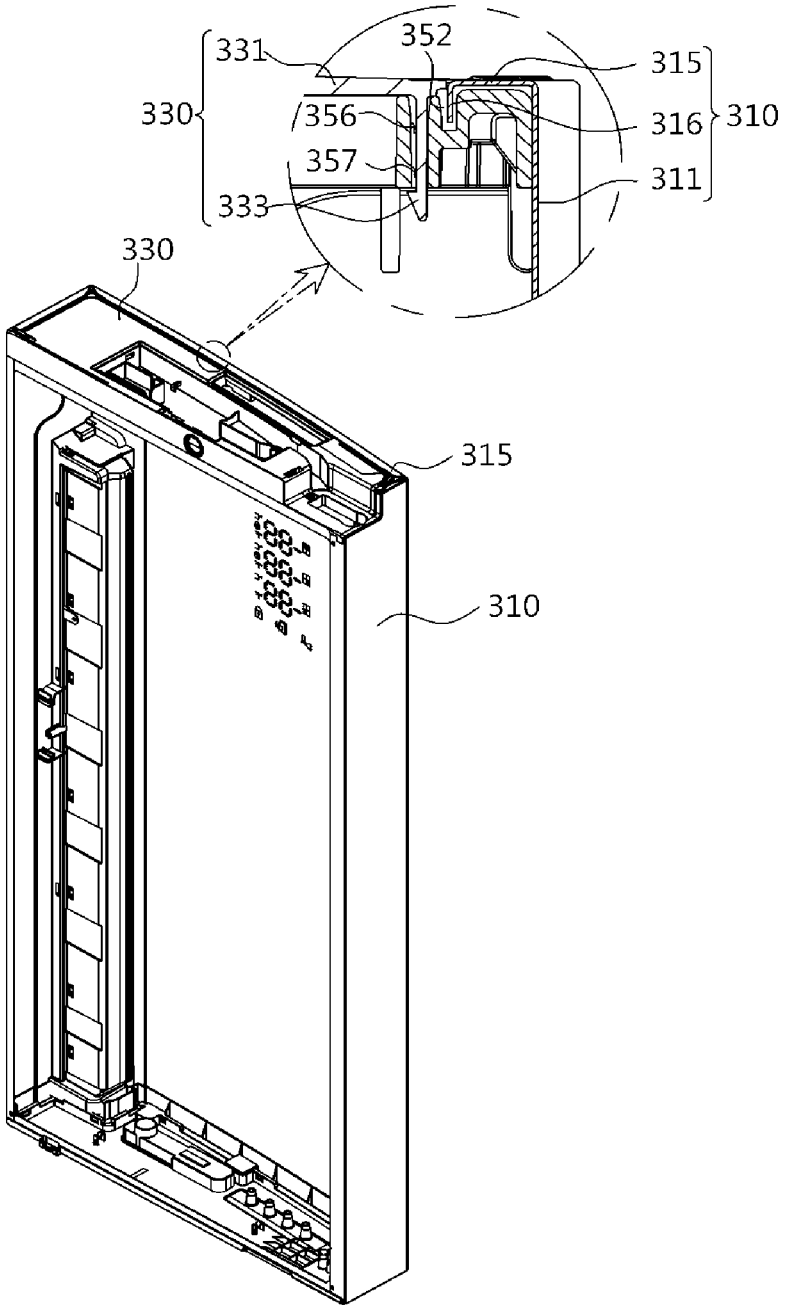
FIG. 22B is a view illustrating a state in which a door cap of a door assembly of FIG. 18 is coupled to a connection member.

FIG. 21 is a perspective view illustrating a connection member of a door assembly of FIG. 18, FIG. 22A is a view illustrating a state in which a front panel of a door assembly of FIG. 18 is coupled to a connection member, and FIG. 22B is a view illustrating a state in which a door cap of a door assembly of FIG. 18 is coupled to a connection member.

Referring to FIGS. 18 to 22B, the connection member 350 may include a first connection unit 351. The first connection unit 351 may be coupled to one side of the front panel 310. The first connection unit 351 may include at least one first locking unit 353. The first locking unit 353 may be coupled to the first coupling hole 317 provided in the front panel 310. A plurality of the first locking unit 353 may be provided apart from each other by a certain gap.

As illustrated in FIG. 21, the first connection unit 351 may further include a first groove 352. The first groove 352 may be formed on one side of an upper surface of the connection member 350. The first groove 352 may be provided in parallel to the front panel 310 with a certain gap. The first groove 352 may be provided in a position corresponding to the second coupling unit 316 of the front panel 310. In a state in which the connection member 350 is coupled to the front panel 310, the first groove 352 may be provided to allow the second coupling unit 316 to be placed in the inside thereof.

The first locking unit 353 may be provided in the same line as the first groove 352. The first locking unit 353 may be coupled to the first coupling hole 317 in a state in which the second coupling unit 316 is placed in the inner side of the first groove 352. Accordingly, when the second coupling unit 316 is inserted into the first groove 352, the first locking unit 353 may be automatically coupled to the first coupling hole 317. As mentioned above, the first groove 352 may play a role of guiding a coupling position of the front panel 310.

The connection member 350 may further include a second connection unit 355. The second connection unit 355 may be provided to allow one side of the bottom cap 340 to be coupled thereto. The second groove 355 may include a second coupling hole 357. The second coupling hole 357 may be coupled to the door cap coupling member 333 of the top cap 330. The second coupling hole 357 may be placed in a position that is more inner side of the door assembly 300 than the first locking unit 353. A plurality of the second coupling hole 357 may be provided apart from each other by a certain gap.

As illustrated in FIG. 21, the second connection unit 355 may further include the second groove 356. The second groove 356 may be formed on one side of the upper surface of the connection member 350. The second groove 356 may be provided in parallel to the first groove 352. On the upper surface of the connection member 350, the second groove 356 may be placed in a position that is more inner side of the door assembly 300 than the first groove 352.

The second coupling hole 357 may be provided on one side of the inside of the second groove 356. In the inside of the second groove 356, the second coupling hole 357 may be placed in a position corresponding to the door cap coupling member 333 so that the second coupling hole 357 is coupled to the door cap coupling member 333 of the top cap 330. The second groove 356 may be disposed in parallel to each other in the inside of the first groove 352, and the second coupling hole 357 may be provided on one side of the inside of the second groove 356. Accordingly, the front surface of the top cap 330 coupled to the connection member 350 may be configured to face the front panel 310 coupled to the connection member 350.

The connection member 350 may further include a guide unit 358. The guide unit 358 may be provided on an outside of the first groove 352. As illustrated in FIG. 22, the guide unit 358 may have a shape corresponding to a space that is surrounded by the front side 311 of the front panel 310, the first coupling unit 315 and the second coupling unit 316. Due to this reason, in a state in which the front panel 310 is coupled to the connection member 350, the guide unit 358 may be placed in the space surrounded by the front side 311 of the front panel 310, the first coupling unit 315 and the second coupling unit 316. Accordingly, in a state in which the guide unit 358 faces to the inner side of the front panel 310, a user may move the guide unit 358 toward the upper side along the front panel 310 so that the connection member 350 may be coupled to the front panel 310.

Hereinafter according to the embodiment, a method for producing a door assembly configured to produce a door assembly configured to open and close a storage compartment of a refrigerator will be described. Hereinafter for convenience of description, a door assembly of FIG. 18 will be described as an example, but is not limited thereto.

Figure 23:
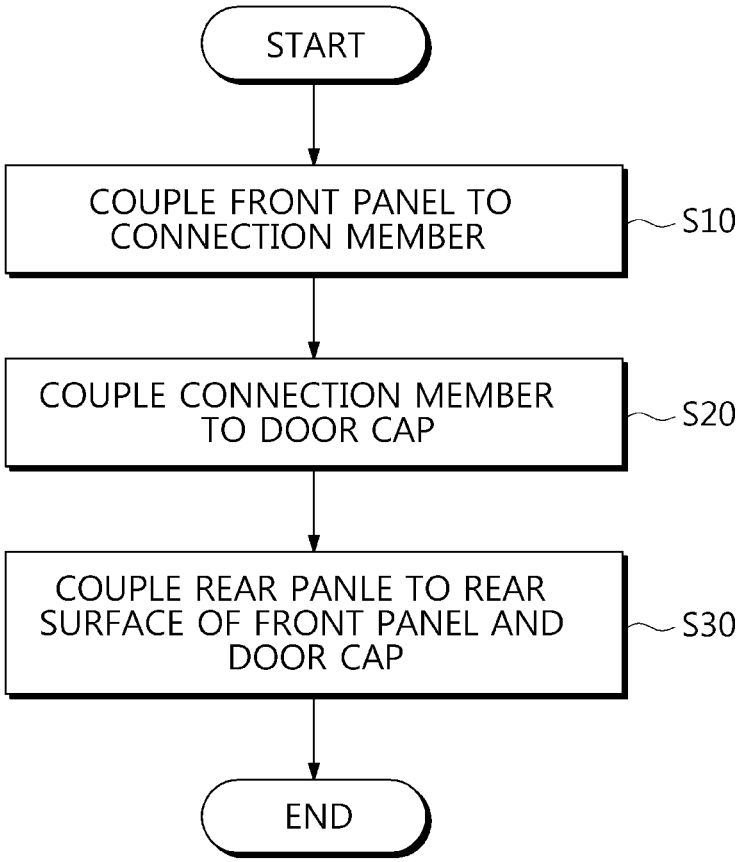
FIG. 23 is a flowchart illustrating a method for producing a door assembly in accordance with an embodiment of the present disclosure.

FIG. 23 is a flowchart illustrating a method for producing a door assembly in accordance with an embodiment of the present disclosure.

Referring to FIG. 23, according to the embodiment of the present disclosure, a method for producing a door assembly may include coupling the connection member 350 to the upper portion or the lower portion of the front panel 310 (S 10), coupling the door cap 330 and 340 to the connection member 350 (S 20), coupling the rear panel 320 to the rear surface of the front panel 310 and the door cap 330 and 340 (S 30) while coupling the door cap 330 and 340 to the connection member 350 coupled to the front panel 310.

During coupling the front panel 310 to the connection member 350 (S 10), the first coupling hole 317 of the front panel 310 may be coupled to the first locking unit 353 of the connection member 350. The plurality of the first coupling hole 317, which is respectively provided in the upper portion and the lower portion of the front panel 310, may be coupled to the first locking unit 353 of the connection member 350 that is provided in the number corresponding to the number of the first coupling hole 317. The first locking unit 353 provided in the connection member 350 may be insertedly coupled to the first coupling hole 317 provided on one side of the front panel 310.

For example, the second coupling unit 316 of the front panel 310 may be inserted into the inner side of the first groove 352 so that the first locking unit 353 may be coupled to the first coupling hole 317. In this case, the first groove 352 and the second coupling unit 316 may guide the coupling between the first locking unit 353 and the first coupling hole 317.

While the guide unit 358 of the connection member 350 moves to the upper side along the front panel 310 in a state of facing the inner side of the front panel 310, the front panel 310 may be coupled to the connection member 350. When the guide unit 358 moves to the upper side along the front panel 310 in a state of facing the inner side of the front panel 310, the guide unit 358 may be moved to the inner side of the space surrounded by the front side 311, the first coupling unit 315 and the second coupling unit 316 so that the first locking unit 353 may be coupled to the first coupling hole 317. In this case, the guide unit 358 may guide the coupling between the first locking unit 353 and the first coupling hole 317 to allow the front panel 310 to be more easily coupled to the connection member 350.

During coupling the door cap 330 and 340 to the connection member 350 coupled to the front panel 310 (S 20), the door cap coupling member 333 of the door cap 330 and 340 may be insertedly coupled to the second coupling hole 357 of the connection member 350. Since the second coupling hole 357 of the connection member 350 is placed in the inside of the second groove 356, the door cap coupling member 333 may be moved to the inside of the second groove 356 to be coupled to the second coupling hole 357.

The coupling the door cap 330 and 340 to the connection member 350 coupled to the front panel 310 (S 20) may be performed after coupling the connection member 350 to the front panel 310. In this case, in the upper portion of the connection member 350 fixed to the front panel 310, the door cap 330 and 340 may be coupled to the connection member 350 while being moved to the lower side.

Alternatively, the coupling the door cap 330 and 340 to the connection member 350 coupled to the front panel 310 (S 20) may be performed prior to coupling the connection member 350 to the front panel 310. In this case, the connection member 350 to which the door cap 330 and 340 is coupled may be coupled to the front panel 310.

After the door cap 330 and 340 is coupled to the connection member 350, the rear panel 320 may be coupled to the rear surface of the front panel 310 and the door cap 330 and 340 (S 30). By using the process, it may be possible to produce the door assembly 300 provided with an inner space filled with the insulation.

As mentioned above, according to the embodiment of the present disclosure, the front panel 310 may be coupled to the door cap 330 and 340 without a direct connection between the front panel 310 and the door cap 330 and 340. The connection member 350 may be coupled to the front panel 310 and the door cap 330 and 340, respectively so that the front panel 310 may be fixed-coupled to the door cap 330 and 340. Accordingly, the door cap 330 and 340 may be fixed to the upper portion or the lower portion of the front panel 310 without changing the shape of the front panel 310 and the door cap 330 and 340. The reliability of the product may be improved by preventing cracking or debonding which may occur caused by the coupling between the front panel 310 and the door cap 330 and 340. In addition, the assembly efficiency may be improved by simplifying the assembly process of the front panel 310 and the door cap 330 and 340. It may be possible to improve the aesthetic sense by preventing a gap between the front panel 310 and the door cap 330 and 340 in the front surface of the refrigerator, from being exposed.

Hereinbefore a process in which the front panel 310 and the top cap 330 are coupled to each other via the connection member 350 is described. In the same method, the front panel 310 of the door and the bottom cap 340 may be coupled to each other via the connection member 350. In addition, the upper door 21 and 22 and the lower door 31 and 32 of the refrigerator 1 may be coupled to the front panel or the top cap or the bottom cap via the connection member 350, as mentioned above.

Hereinafter a door assembly 301 according to a modified embodiment of the present disclosure will be described.

Figure 24:
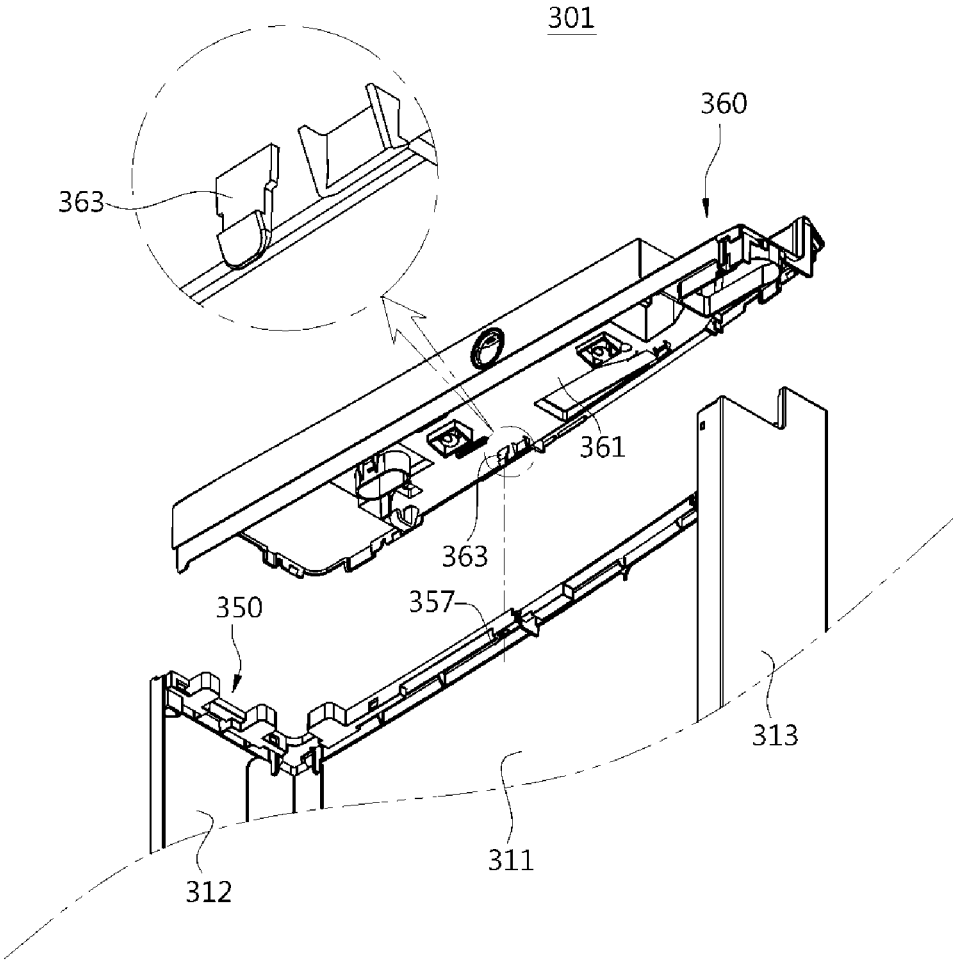
FIG. 24 is a view illustrating a door cap of a door assembly in accordance with a modification of a door assembly of FIG. 18 when seen from the bottom.
Figure 25:
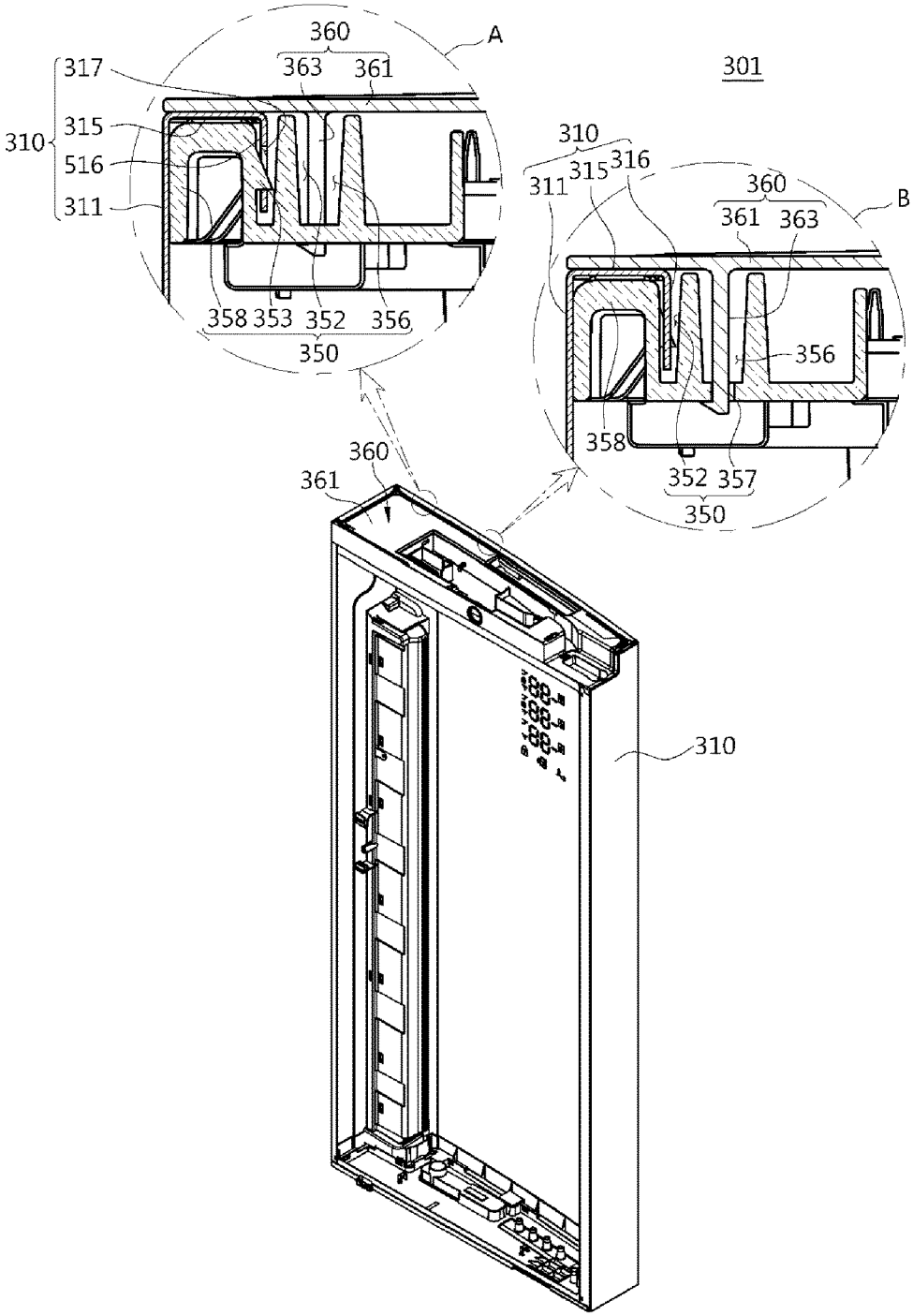
FIG. 25 is an enlarged cross-sectional view illustrating a case in which a door assembly of FIG. 24 is coupled.

FIG. 24 is a view illustrating a door cap of a door assembly in accordance with a modification of a door assembly of FIG. 18 when seen from the bottom, and FIG. 25 is an enlarged cross-sectional view illustrating a case in which a door assembly of FIG. 24 is coupled.

Referring to FIGS. 24 and 25, according to a modification of a door assembly of FIG. 18, a door assembly 301 may include a front panel 310, a rear panel 320, a door cap 360 and a connection member 350. In comparison with the door assembly 300 of FIG. 18, the door assembly 301 may be provided with the door cap 360 having different configuration and the rest component may be the same. Hereinafter a difference between the door assembly 301 and the door assembly 300 of FIG. 18 will be mainly described.

A front end of the door cap 360 may be provided on an upper portion of the front panel 310 in a state in which the door cap 360 is coupled to the connection member 350. Therefore, the door cap 360 may be provided such that a lower surface of the door cap 360 makes contact with an upper surface of the first coupling unit 315 of the front panel 310. For example, when seen from above, a front end of the door cap 360 may be placed in the same position as a front end of the front panel 310.

In comparison with the door cap 330 of FIG. 18, the door cap 360 may be provided to cover an upper portion of the front panel 310 in a state of being coupled to the connection member 350. Therefore, the front surface of the door cap 360 may be more extended than the door cap 330 of FIG. 18 and the upper surface of the door cap 360 may be placed higher than the door cap 330 of FIG. 18.

On one side of the lower surface of the door cap 360, a door cap coupling member 363 may be provided. The door cap coupling member 363 may be provided in a rear side by a certain gap from the front end of the lower surface of the door cap 360. The door cap coupling member 363 may be placed in a position corresponding to the second coupling hole 357 of the connection member 350.

Hereinafter a door assembly 302 in accordance with another embodiment of the present disclosure will be described.

Figure 26:
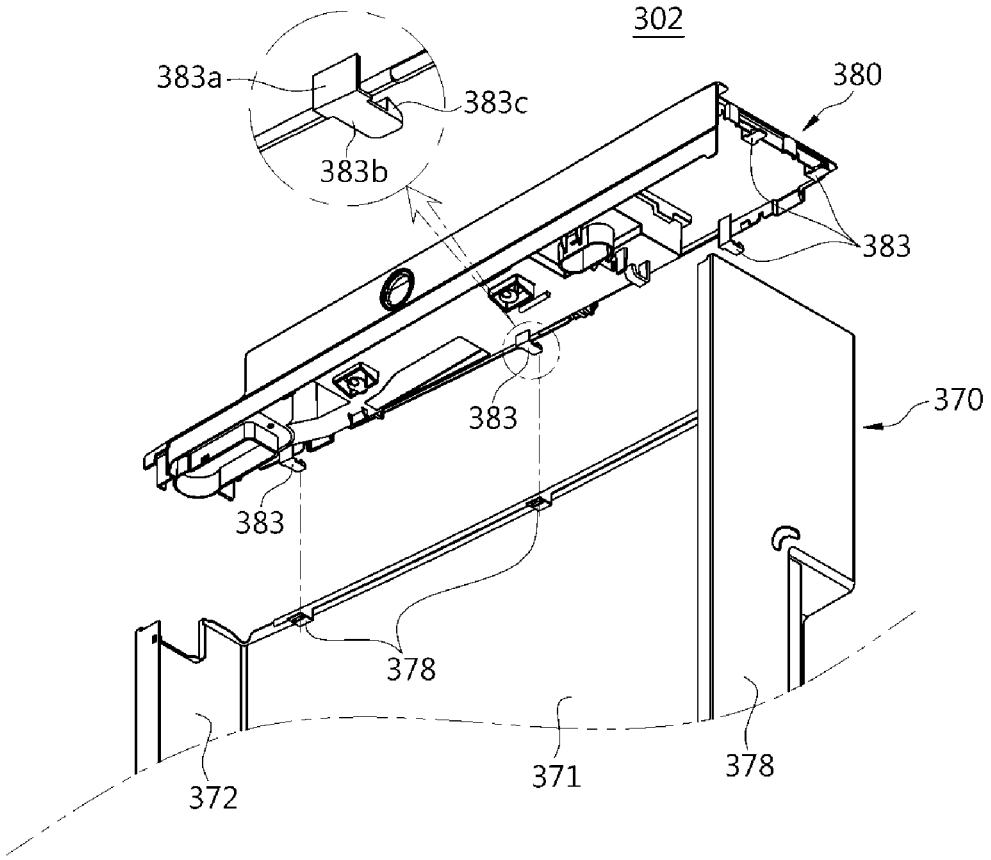
FIG. 26 is a view illustrating a door assembly in accordance with another embodiment of the present disclosure.
Figure 27:
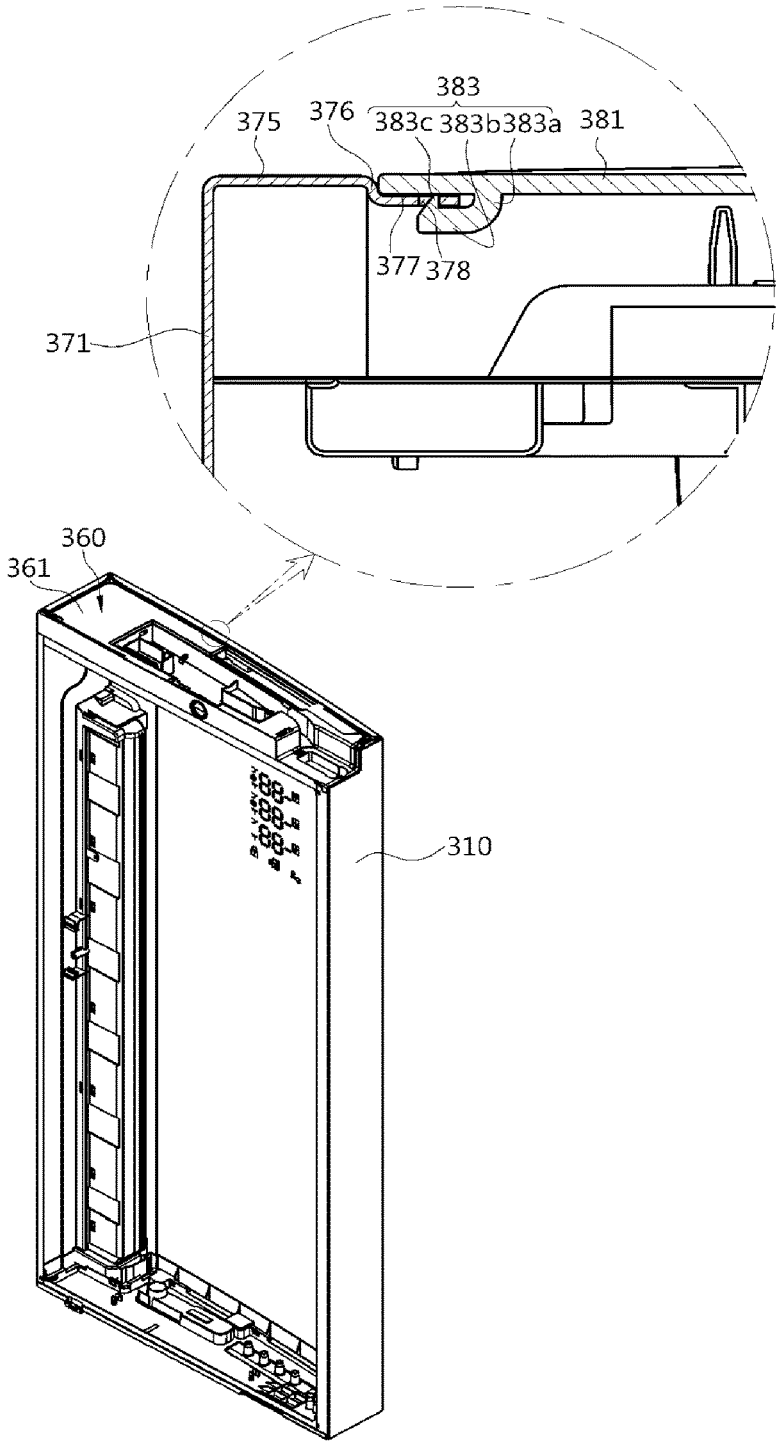
FIG. 27 is an enlarged cross-sectional view illustrating a case in which a door assembly of FIG. 26 is coupled.

FIG. 26 is a view illustrating a door assembly in accordance with another embodiment of the present disclosure, and FIG. 27 is an enlarged cross-sectional view illustrating a case in which a door assembly of FIG. 26 is coupled.

Referring to FIGS. 26 and 27, according to another embodiment of the present disclosure, a door assembly 302 may include a front panel 370, a rear panel 320, and a door cap 380. In comparison with the door assembly 300 of FIG. 18, the connection member 350 may be omitted, and the door assembly 302 may be provided with the door cap 380 having different configuration. A description of the rest component will be omitted since the rest component is provided in the same as the door assembly 300 of FIG. 18. Hereinafter a difference between the door assembly 302 and the door assembly 300 of FIG. 18 will be mainly described.

The front panel 370 may include a first coupling unit 375 extended in an inner direction of the door assembly 302; a second coupling unit 376 extended from one side of the first coupling unit 375 to a lower side; and a third coupling unit 377 extended from one side of the second coupling unit 376 to the inner direction of the door assembly 302. The first coupling unit 375, the second coupling unit 376 and the third coupling unit 377 may be formed such that a single panel is bent. A plurality of the first coupling unit 375, the second coupling unit 376 and the third coupling unit 377 may be provided.

In the front panel 370, a door cap coupling hole 378 may be formed. The door cap coupling hole 378 may be coupled to one side of the door cap 380 described later. For example, the door cap coupling hole 378 may be provided in the third coupling unit 377.

The door cap 380 may be coupled to one side of an upper portion of the front panel 370. The door cap 380 may include a door cap coupling member 383 provided in one side thereof and configured to couple the door cap 380 to the front panel 370.

The door cap coupling member 383 may include a first door cap coupling unit 383*a*; a second door cap coupling unit 383*b*; and a protrusion 383*c*. The door cap coupling member 383 may be installed in a lower surface of a body 381 of the door cap 380. The door cap coupling member 383 may be placed in a position corresponding to the first coupling unit 375 of the front panel 370. The door cap coupling member 383 may be provided in the same number as the first coupling unit 375.

The first door cap coupling member 383*a* may be extended from the lower surface of the body 381 of the door cap to the lower side. A lower end of the first door cap coupling member 383*a* may be placed lower than the third coupling unit 377 of the front panel 370.

The second door cap coupling member 383*b* may be extended from one side of the first door cap coupling member 383*a* to the front panel 370. The second door cap coupling member 383*b* may be disposed to face the lower surface of the third coupling unit 377 of the front panel 370.

The protrusion 383*c* may be provided in an upper surface of the second door cap coupling member 383*b*. The protrusion 383*c* may be protruded from the upper surface of the door cap coupling member 383*b* toward an upper side. The protrusion 383*c* may be provided to be coupled to the door cap coupling hole 378 provided in the third coupling unit 377 of the front panel 370.

In a case of the door assembly 302, the protrusion 383*c* of the door cap 380 may be coupled to the door cap coupling hole 378 provided in the third coupling unit 377 of the front panel 370. By using the above-mentioned configuration, in a case of the door assembly 302, the front panel 370 may be easily coupled to the door cap 380.

Hereinafter a modification 303 of the door assembly of FIG. 26 will be described.

In comparison with the door assembly 302 of FIG. 26, a configuration of a front panel 370 and a door cap 380 of a door assembly 303 may be partially different from that of the door assembly 302, and the other configuration thereof may be the same as the door assembly 302. Hereinafter a difference between the door assembly 303 and the door assembly 302 of FIG. 26 will be mainly described.

Figure 28:
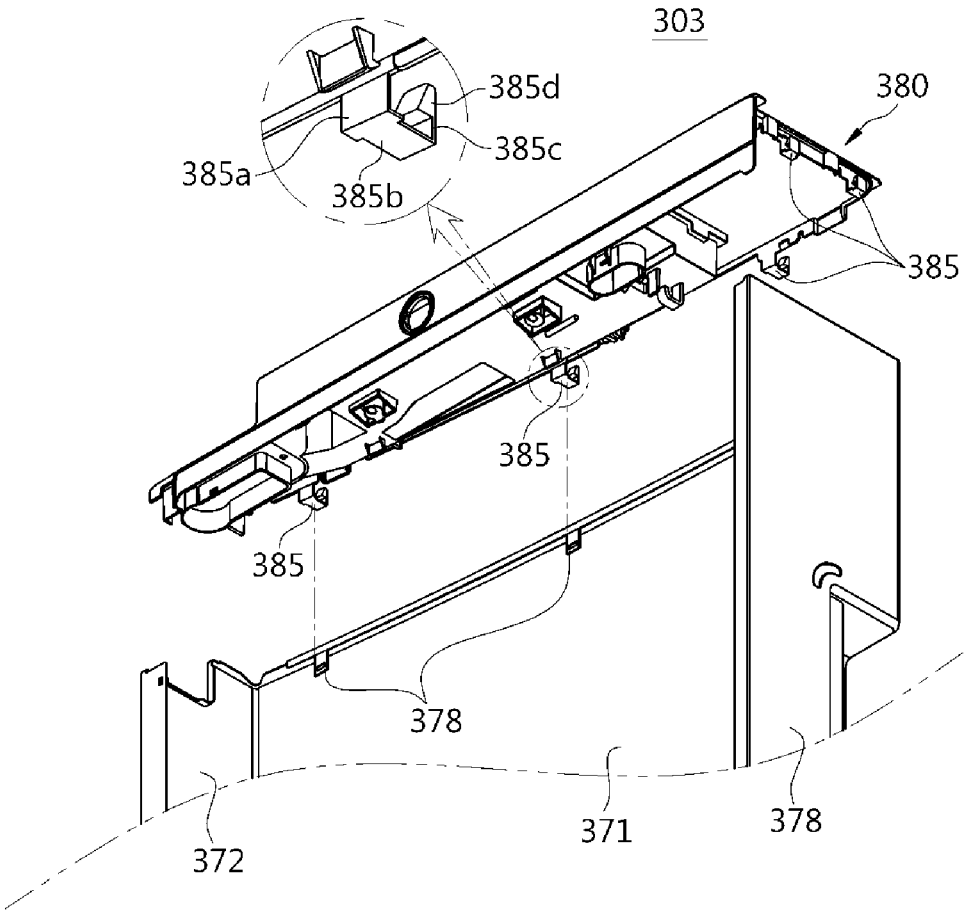
FIG. 28 is a view illustrating a modification of a door assembly of FIG. 26.
Figure 29:
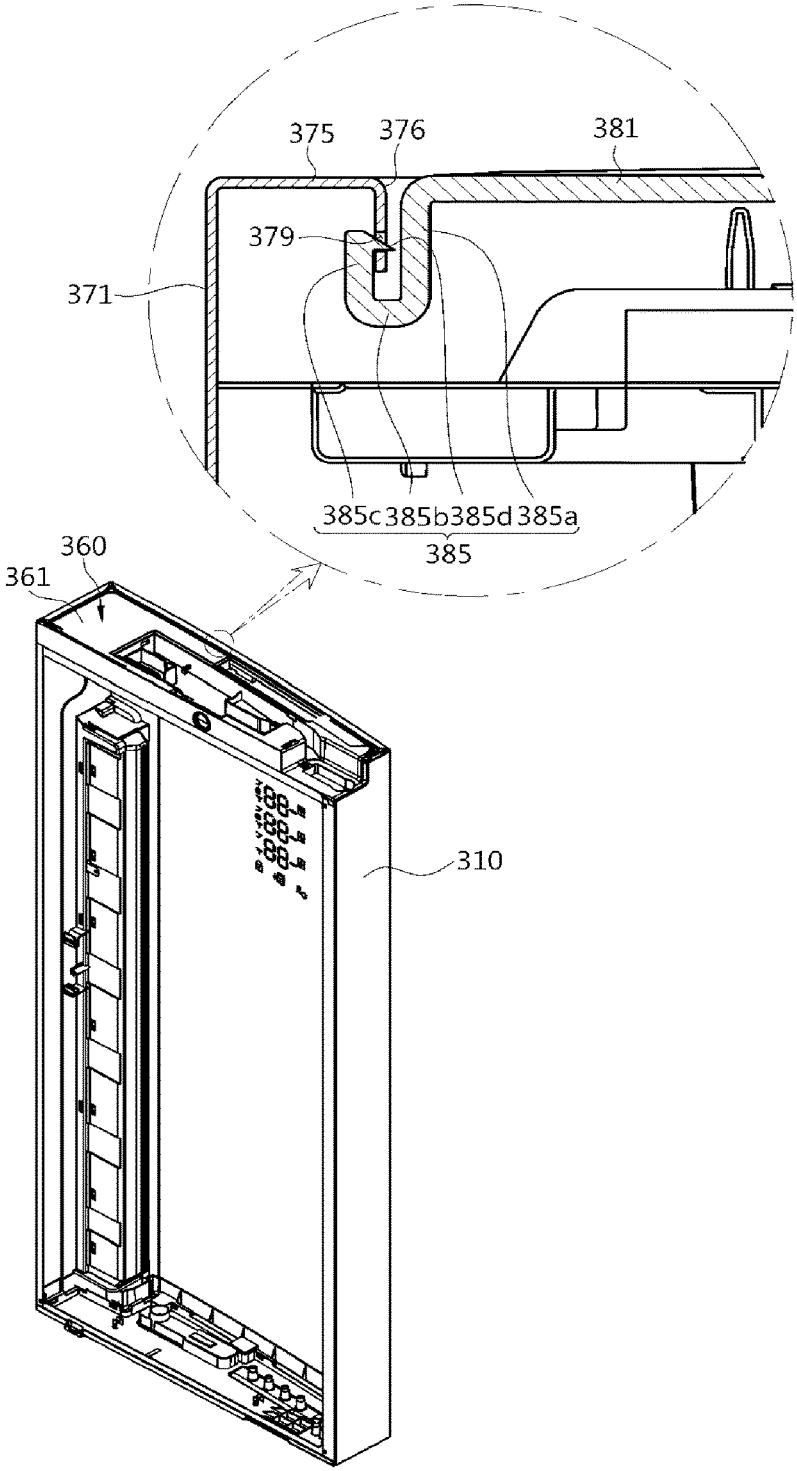
FIG. 29 is an enlarged cross-sectional view illustrating a case in which a door assembly of FIG. 28 is coupled.

FIG. 28 is a view illustrating a modification of a door assembly of FIG. 26, and FIG. 29 is an enlarged cross-sectional view illustrating a case in which a door assembly of FIG. 28 is coupled.

Referring to FIGS. 28 and 29, the door assembly 303 may include a front panel 370, a rear panel 320, and a door cap 380.

The front panel 370 may include a first coupling unit 375 extended from an upper end to an inner direction of the door assembly 302 and a second coupling unit 376 extended from one side of the first coupling unit 375 to a lower side. The first coupling unit 375 and the second coupling unit 376 may be formed such that a single panel is bent. A plurality of the first coupling unit 375 and the second coupling unit 376 may be provided.

In the front panel 370, a door cap coupling hole 379 may be formed. The door cap coupling hole 379 may be coupled to one side of the door cap 380 described later. For example, the door cap coupling hole 379 may be provided in the second coupling unit 376.

The door cap 380 may be coupled to one side of an upper portion of the front panel 370. The door cap 380 may include a door cap coupling member 385 provided in one side thereof and configured to couple the door cap 380 to the front panel 370.

The door cap coupling member 385 may include a first door cap coupling unit 385*a*; a second door cap coupling unit 385*b*; a third door cap coupling unit 385*c*; and a protrusion 385*d*. The door cap coupling member 385 may be installed in a lower surface of a body 381 of the door cap 380. The door cap coupling member 385 may be placed in a position corresponding to the door cap coupling hole 378 of the front panel 370. The door cap coupling member 385 may be provided in the same number as the door cap coupling hole 378.

The first door cap coupling unit 385*a* may be extended from the lower surface of the body 381 of the door cap to the lower side. A lower end of the first door cap coupling unit 385*a* may be placed lower than the second coupling unit 376 of the front panel 370.

The second door cap coupling unit 385*b* may be extended from the one side of the first door cap coupling unit 385*a* to the front panel 370. The second door cap coupling unit 385*b* may be disposed to face the lower surface of the second coupling unit 376 of the front panel 370.

The third door cap coupling unit 385*c* may be extended from one side of the second door cap coupling unit 385*b* to the upper side. The third door cap coupling unit 385*c* may be placed between a front side 371 and the second coupling unit 376 of the front panel 370 in a state in which the front panel 370 is coupled to the door cap 380.

The protrusion 385*d* may be provided on one side of the third door cap coupling unit 385*c*. The protrusion 385*d* may be provided to face the door cap coupling hole 378. The protrusion 385*d* may be inserted into the door cap coupling hole 378 to fix the front panel 370 to the door cap 380.

In a case of the door assembly 303, the protrusion 385*d* of the door cap 380 may be coupled to the door cap coupling hole 378 provided in the second coupling unit 376 of the front panel 370. By using the above-mentioned configuration, in a case of the door assembly 303, the front panel 370 may be easily coupled to the door cap 380.

Figure 30:
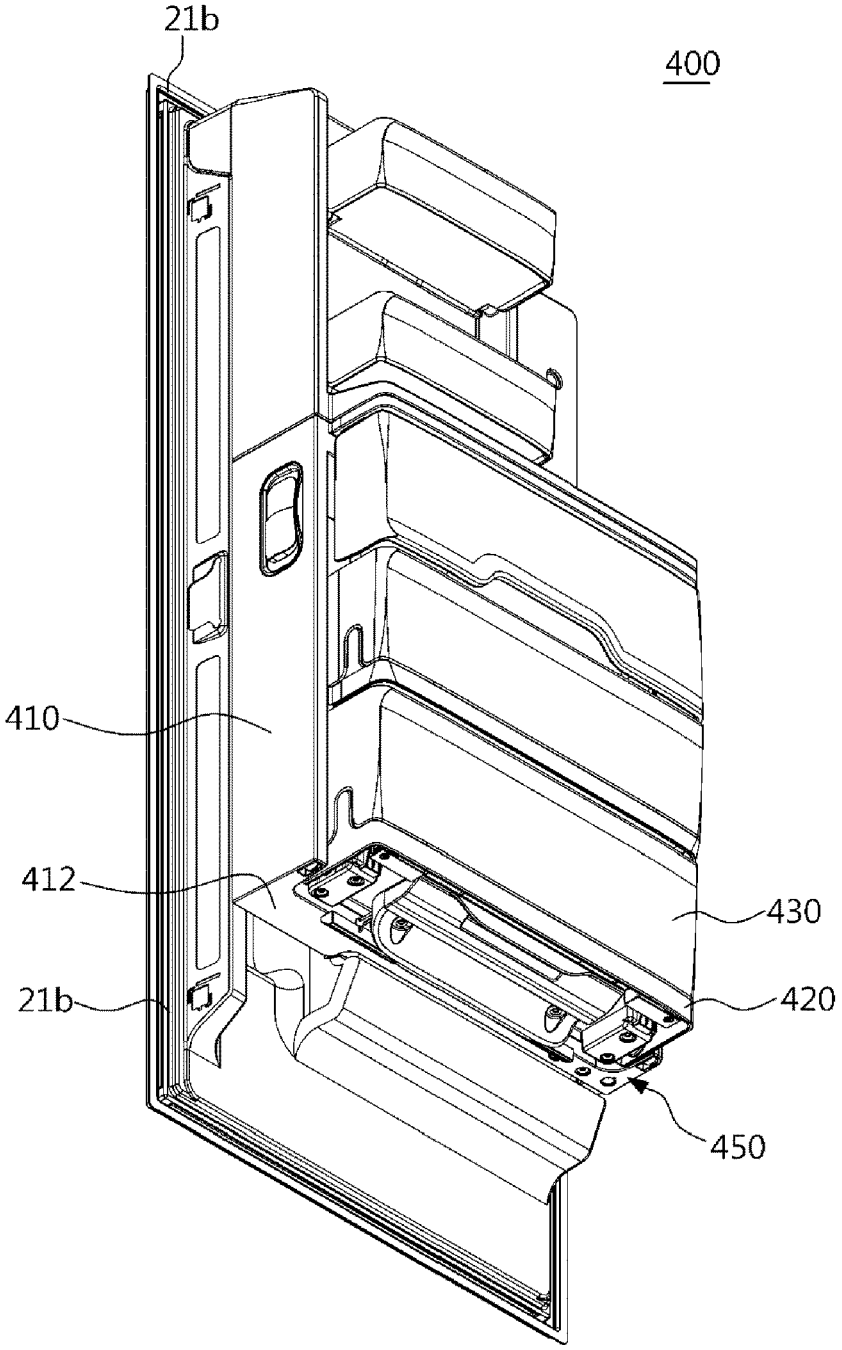
FIG. 30 is a perspective view illustrating a tilt guard assembly installed in a rear surface of a door of FIG. 2.
Figure 31:
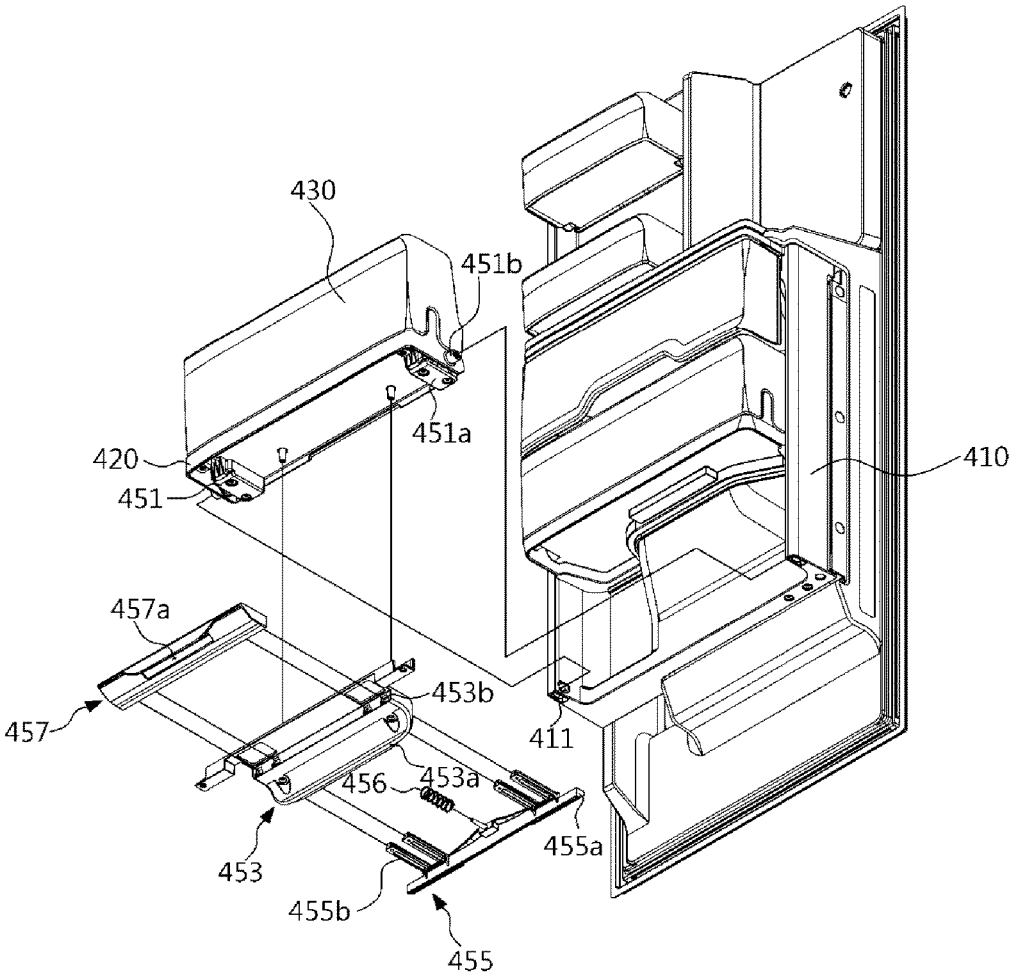
FIG. 31 is an exploded perspective view illustrating a configuration of a tilt guard assembly of FIG. 30.

FIG. 30 is a perspective view illustrating a tilt guard assembly installed in a rear surface of a door of FIG. 2, and FIG. 31 is an exploded perspective view illustrating a configuration of a tilt guard assembly of FIG. 30.

Referring to FIGS. 30 and 31, a tilt guard assembly 400 may include a tilt body 410; a tray 420; a guard 430; a tilt unit 450. The tilt guard assembly 400 may be installed in a rear surface 21*b* of the door and thus the tilt guard assembly 400 may be placed in the inside of the refrigerator when the door is closed.

The tilt body 410 may be coupled to the rear surface of the door. The tilt body 410 may be provided such that the rear surface of the tilt body 410 makes contact with the rear panel 21*b* of the door. The tilt body 410 may be coupled to the tray 420 and the guard 430 to form a storage space.

According to the embodiment, the tilt body 410 may include a fixation hole 411 provided in a left side and a right side of the tilt body 410. The fixation hole 411 of the left side and the fixation hole 411 of the right side may be provided in the same height. The fixation hole 411 may be provided in plural according to the number of the tray 420.

For example, when more than two trays 420 are provided in the tilt guard assembly 400, the fixation hole 411 may be provided in the left side and the right side in a height in which each tray 420 is placed.

A rotation adjustment unit 451 described later may be inserted into the fixation hole 411. Accordingly, the tilt body 410 may be coupled to the tray 420.

The tray 420 may have a plate shape having a certain thickness. The tray 420 together with the tilt body 410 may form a storage space in the rear surface of the door. On the tray 420, foods placed in the storage space in the rear surface of the door may be positioned. For example, the tray 420 may be provided in plural.

A connection hole 421 may be installed in the left side and the right side of the tray 420. The connection hole 421 in the left side and the connection hole 421 in the right side may be placed to be overlapped when seen from the side. In addition, when seen from the side in a state in which the tray 420 is coupled to the tilt body 410, the connection hole 421 may be placed to be overlapped with the fixation hole 411 of the tilt body 410. For example, the connection hole 421 may be placed on the rear side of the lateral side of the tray 420.

The tilt adjustment member 451 described later may be inserted into the connection hole 421 and accordingly, the tilt body 410 and the tray 420 may be coupled to each other.

The guard 430 may form the storage space with the tray 420 and the tilt body 410. The guard 430 may include a front guard; and a side guard bent from opposite ends of the front guard to a rear side of the storage space. A lower surface of the guard 430 may be fixed to a front end of the upper portion and the opposite sides of the tray 420.

The guard 430 may be formed of transparent material so that the food placed in the storage space allows to be viewed from the outside.

Figure 32:
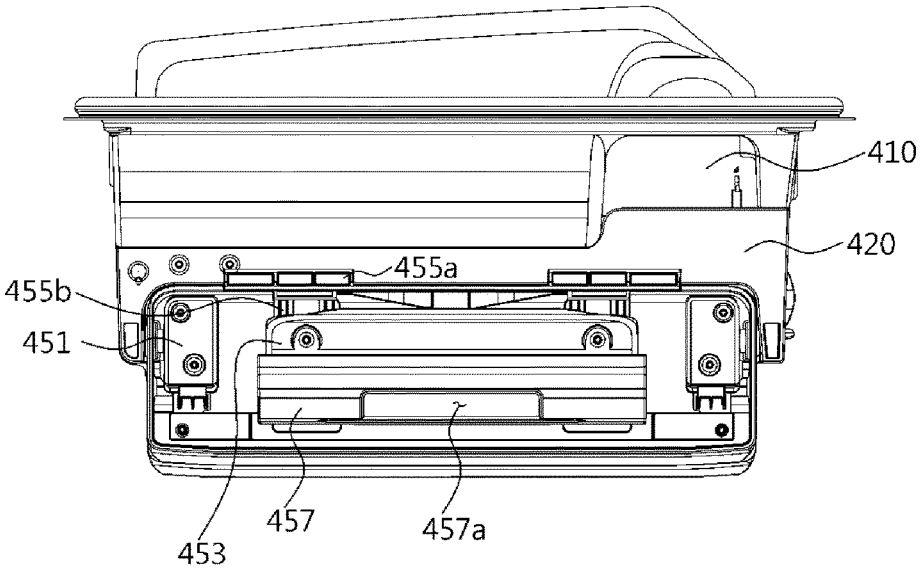
FIG. 32 is a bottom view illustrating a tilt unit of a bottom of a door guard assembly of FIG. 30.
Figure 33:
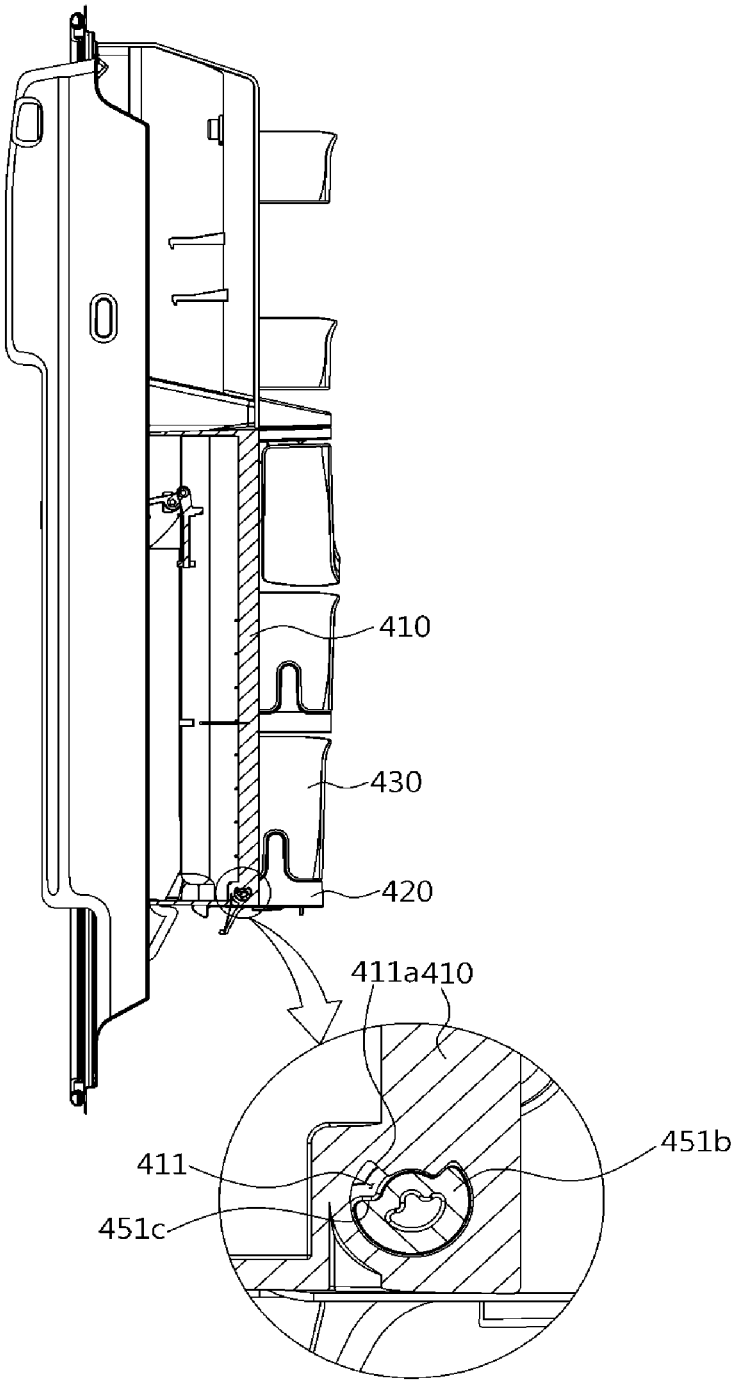
FIG. 33 is a cross-sectional view illustrating a rotation adjustment member of a tilt unit of FIG. 31.

FIG. 32 is a bottom view illustrating a tilt unit of a bottom of a door guard assembly of FIG. 30, and FIG. 33 is a cross-sectional view illustrating a rotation adjustment member of a tilt unit of FIG. 31.

Referring to FIGS. 32 and 33, a tilt unit 450 may include a tilt adjustment member 451; a first tilt locking member 453; a second tilt locking member 455; and a handle member 457. The tilt unit 450 may rotate the tray 420 and the guard 430 with respect to the tilt adjustment member 451 by a certain angle.

The tilt adjustment member 451 may include a supporting unit 451*a* and a rotation axis 451*b*.

One side of the supporting unit 451*a* may be coupled to the lower surface of the tray 420. The supporting unit 451*a* may be rotated with the tray 420, and transmit a rotation force to the rotation axis 451*b*.

The rotation axis 451*b* may be installed in one end of the supporting unit 451*a*. One side of the rotation axis 451*b* may be coupled to the tilt body 410, and the other side of the rotation axis 451*b* may be coupled to the supporting unit 451*a*. The rotation axis 451*b* may be rotatable in the tilt body 410. The rotation axis 451*b* may be rotatable in a state of being inserted into the connection hole 421 and the fixation hole 411.

According to the embodiment, the rotation axis 451*b* may have a locking groove 451*c*. The locking groove 451*c* may be a concaved shape in one side of an outer side of the rotation axis 451*b*.

According to the embodiment, the fixation hole 411 may have a rotation adjustment groove 411*a* recessed toward an inner side. The fixation hole 411 may allow the rotation axis 451*b* that is inserted to be rotated within a certain range. Particularly, the fixation hole 411 may be provided such that one side of the locking groove 451*c* of the rotation axis 451*b* that is rotated inside of the fixation hole 411 is locked by one side of the rotation adjustment groove 411*a*. In this way, a rotation angle of the rotation axis 451*b* may be limited by being inserted into the fixation hole 411.

The first tilt locking member 453 may include a first tilt locking unit 453*a* and a tilt guide hole 453*b*. One side of the first tilt locking member 453 may be fixed to a lower surface of the tray 420. The first tilt locking unit 453*a* may be placed in a rear side of a lower surface of the first tilt locking member 453. The first tilt locking unit 453*a* may be extended from the rear side of the first tilt locking member 453 vertically downward. The first tilt locking unit 453*a* may make contact with the lower surface of the tilt body 410 when the tilt guard assembly 400 is rotated by more than a certain angle. Accordingly, the first tilt locking member 453 may limit a rotation of the tilt guard assembly 400.

The tilt guide hole 453*b* may be provided in one side of the first tilt locking member 453. The tilt guide hole 453*b* may allow a tilt guide unit 455*b* of a second tilt locking member 455 described later to be inserted into the tilt guide hole 453*b* and to be movable back and forth.

The second tilt locking member 455 may include a second tilt locking unit 455*a* and a tilt guide unit 455*b*.

The second tilt locking unit 455*a* may be placed in a rear side of the second tilt locking member 455. The second tilt locking unit 455*a* may be protruded toward the rear side of the second tilt locking member 455. The second tilt locking unit 455*a* may be placed to make contact with the lower surface of the tilt body 410. The second tilt locking unit 455*a* may prevent the tilt guard assembly 400 from being rotated while supporting the lower surface of the tilt body 410.

The tilt guide unit 455*b* may be placed in the front of the second tilt locking member 455. The tilt guide unit 455*b* may be extended from a front surface of the second tilt locking member 455 toward the front side. The tilt guide unit 455*b* may be provided in plural. According to the embodiment, the tilt guide unit 455*b* may be provided in the same number as the tilt guide hole 453*b*.

A restoration member 456 may be provided in all or some of the plurality of the tilt guide unit 455*b*. The restoration member 456 may have a larger cross section than that of the tilt guide hole 453*b*. When the second tilt locking member 455 is moved to the front side by a user, the restoration member 456 may guide the second tilt locking member 455 so that the second tilt locking member 455 is moved to the rear side again. The restoration member 456 may guide the second tilt locking member 455 so that the second tilt locking member 455 returns to a certain position. The restoration member 456 may include a spring.

According to the embodiment, the second tilt locking member 455 may be moved along the tilt guide unit 455*b* of the first tilt locking member 453. The second tilt locking member 455 may be independently movable back and forth on the lower surface of the tray 420. The tilt guide unit 455*b* of the second tilt locking member 455 may be movable back and forth in the inside of the tilt guide hole 453*b* of the first tilt locking member 453 that is fixed. Accordingly, a user may hold on a handle member 457 and move the second tilt locking member 455 thereby rotating the tilt guard assembly 400.

The handle member 457 may be coupled to the second tilt locking member 455. The handle member 457 may be coupled to a front side of the second tilt locking member 455. According to the embodiment, the handle member 457 may be coupled to a front side of a lower surface of the tilt guide unit 455*b*.

The handle member 457 may have a gripping groove 457*a* formed on a bottom of the handle member 457 to be recessed toward an upper portion. A user may grip the gripping groove 457*a* of the handle member 457 and move the second tilt locking member 455 back and forth together with the handle member 457.

Hereinafter a process in which a tilt guard assembly is rotated according to the embodiment will be described.

Figure 34:
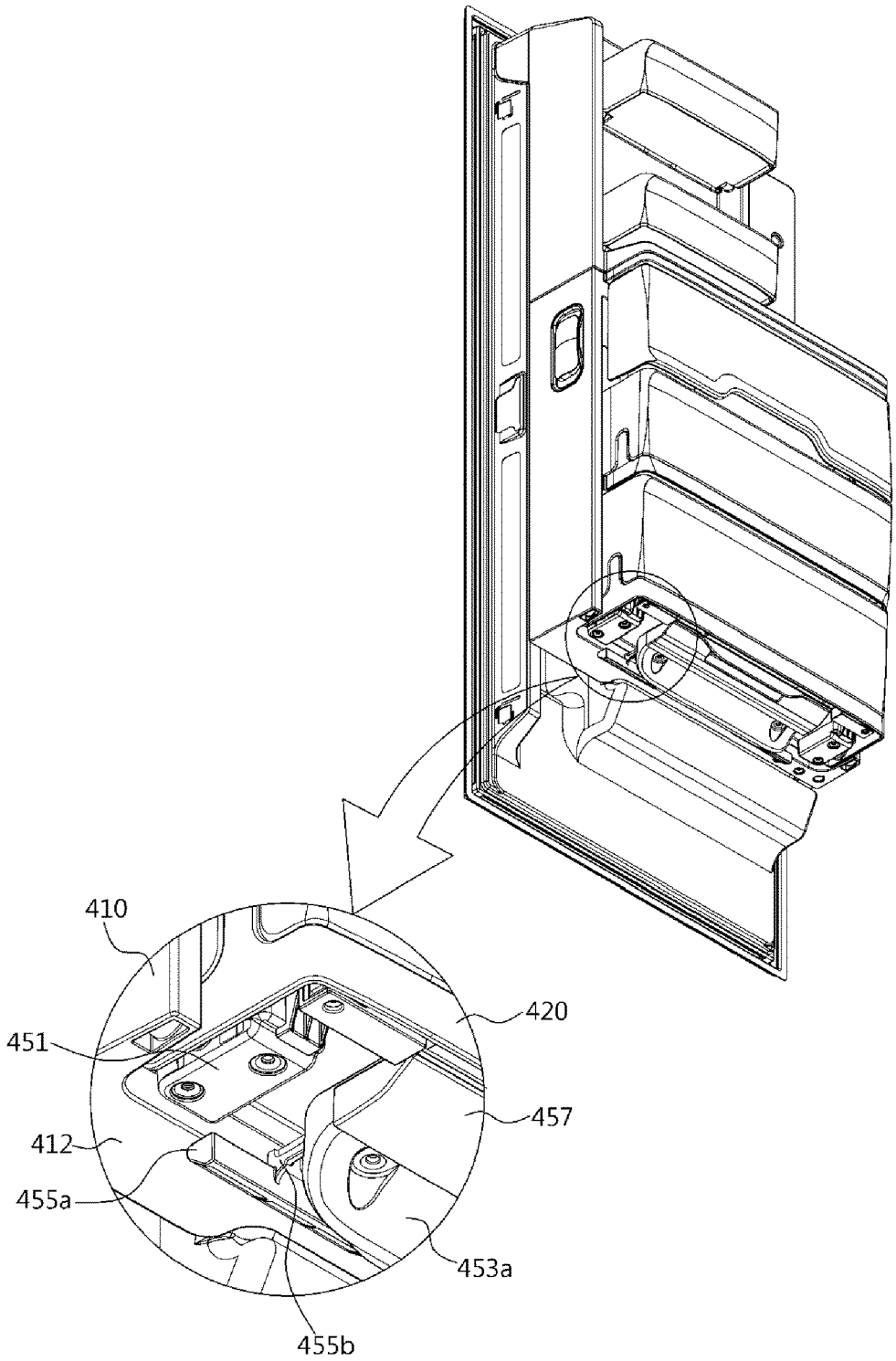
FIGS. 34 to 36 are views illustrating a motion in which a tilt guard assembly of FIG. 30 is rotated by a tilt unit.
Figure 35:
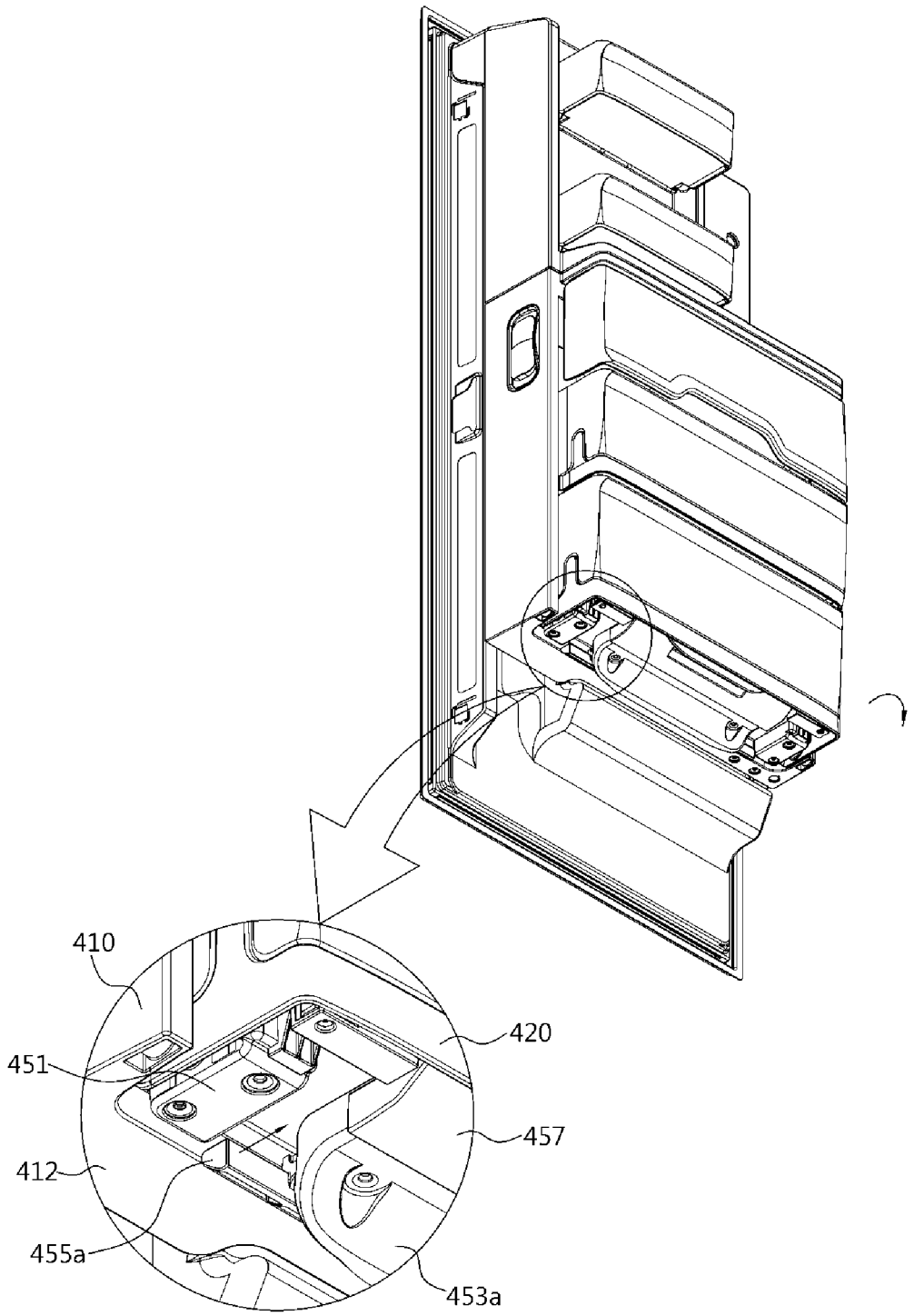
Figure 36:
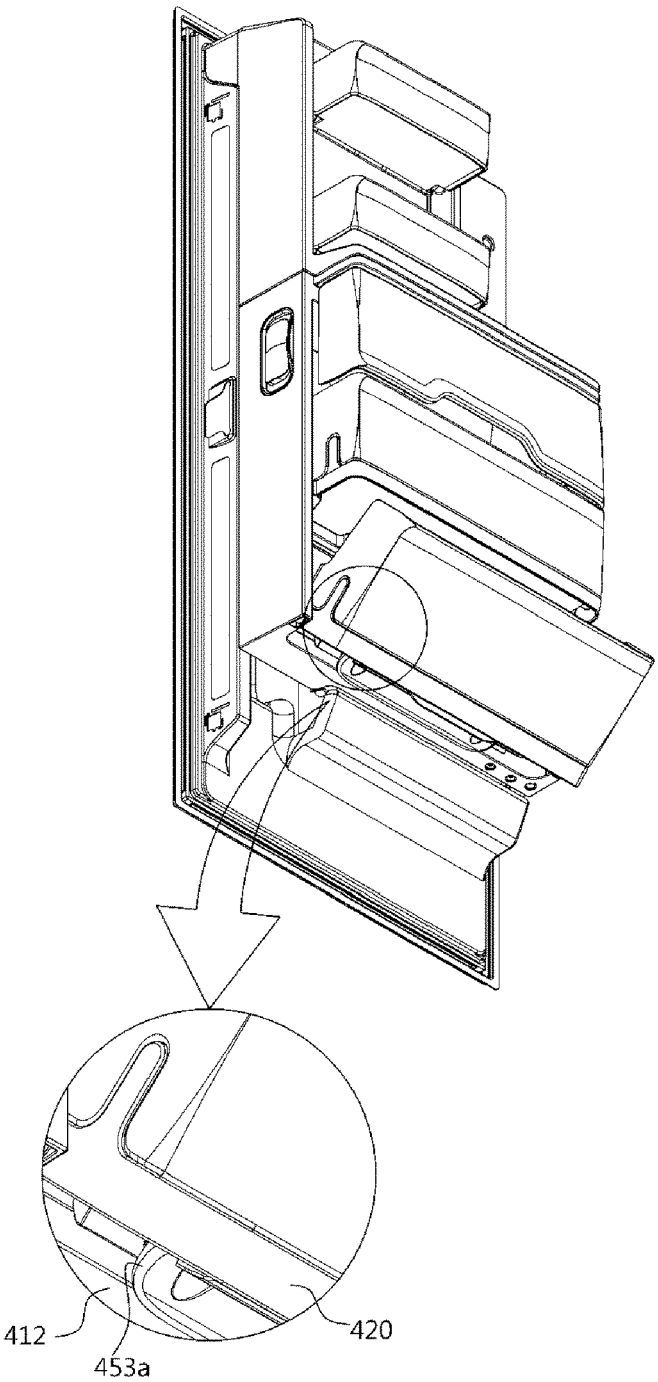

FIGS. 34 to 36 are views illustrating a motion in which a tilt guard assembly of FIG. 30 is rotated by a tilt unit.

The tilt guard assembly 400 may be provided to allow the tray 420 to be rotatable. The tray 420 may be rotated with respect to the rotation axis 451*b* of the tilt unit. The tray 420 may be rotated to allow the guard 430 to open and close the storage space.

Referring to FIG. 34, when the tray 420 is maintained in a closed state, the second tilt locking unit 455*a* may support a tilt body bottom 412. Since the second tilt locking unit 455*a* is locked by the tilt body bottom 412, a rotation of the tray 420 may be prevented and the guard 430 may be maintained in a closed state.

Referring to FIG. 35, when a user pull the handle member 457 toward the front side of the door guard assembly, the second tilt locking member 455 connected to the handle member 457 may be moved in the front side. Accordingly, the second tilt locking unit 455*a* may not support the tilt body bottom 412, and the tray 420 may be rotated to allow the guard 430 to be opened. According to the embodiment, since the rotation axis 451*b* is placed in the rear side of the tray 420, the tray 420 may be automatically rotated when the tilt guide unit 455*b* does not support the tilt body bottom 412.

Referring to FIG. 33, the tray 420 may be not rotated by more than a certain angle. When the tray 420 is rotated by more than a certain angle, the locking groove 451*c* of the rotation axis 451*b* may be locked by one side of the rotation adjustment groove 411*a* of the fixation hole 411 so that the rotation of the tray 420 may be limited.

In addition, referring to FIG. 36, when the tray 420 is rotated by more than a certain angle, the first tilt locking unit 453*a* of the first tilt locking member 453 may be locked by the tilt body bottom 412. Accordingly, the tray 420 may be not allowed to be rotated by more than a certain angle.

As mentioned above, the tilt guard assembly 400 may be provided such that the tray 420 is rotated by a predetermined certain angle and then stopped when a user pulls the handle member 457.

In addition, a user may move the tray 420 and the guard 430 to a position allowing the storage space to be closed. When the user moves the tray 420 and the guard 430 to a position allowing the storage space to be closed, the first tilt locking unit 453*a* may be moved to the rear side by the restoration member 456 while a position supporting the tilt body bottom 412 is moved. Accordingly, the tray 420 may be stopped in a position allowing the storage space to be closed.

Hereinafter a tilt guard assembly in accordance with another embodiment will be described.

Figure 37:
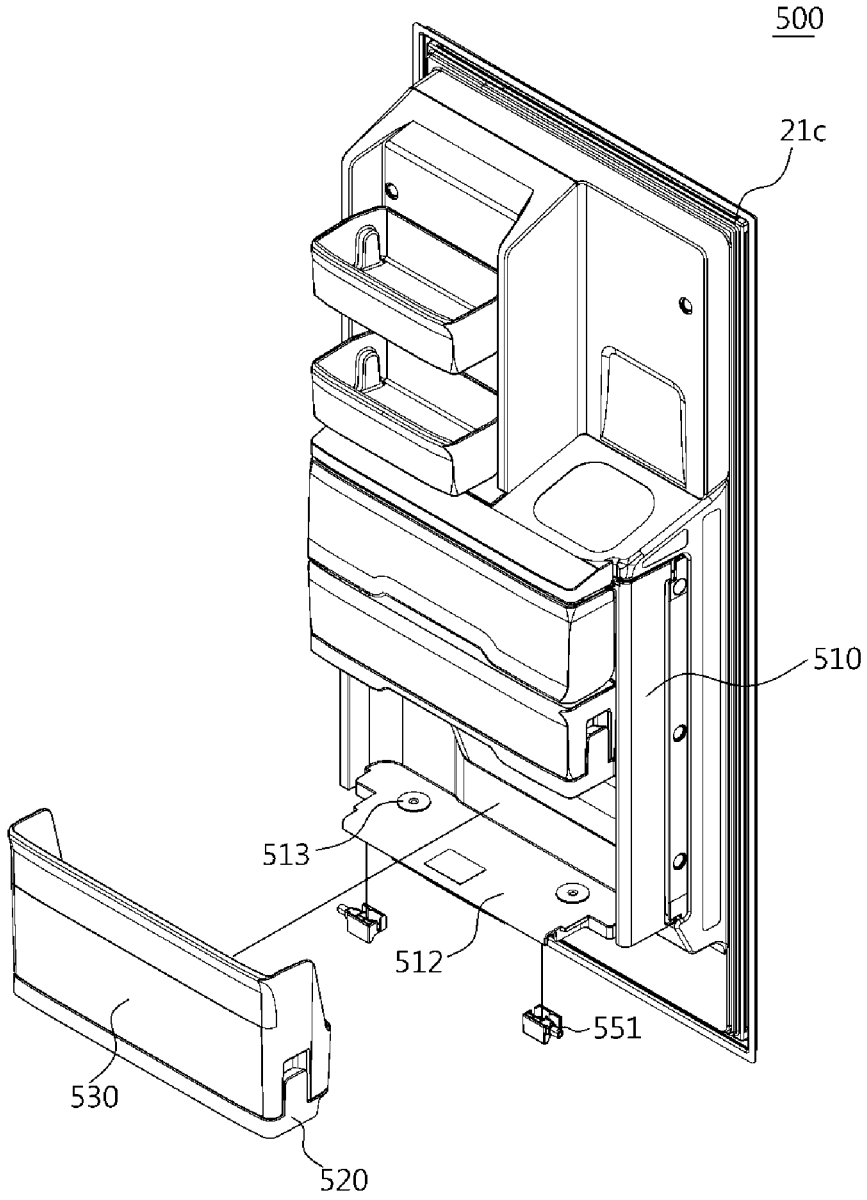
FIG. 37 is an exploded perspective view illustrating a tilt guard assembly when seen from above in accordance with another embodiment of the present disclosure.
Figure 38:
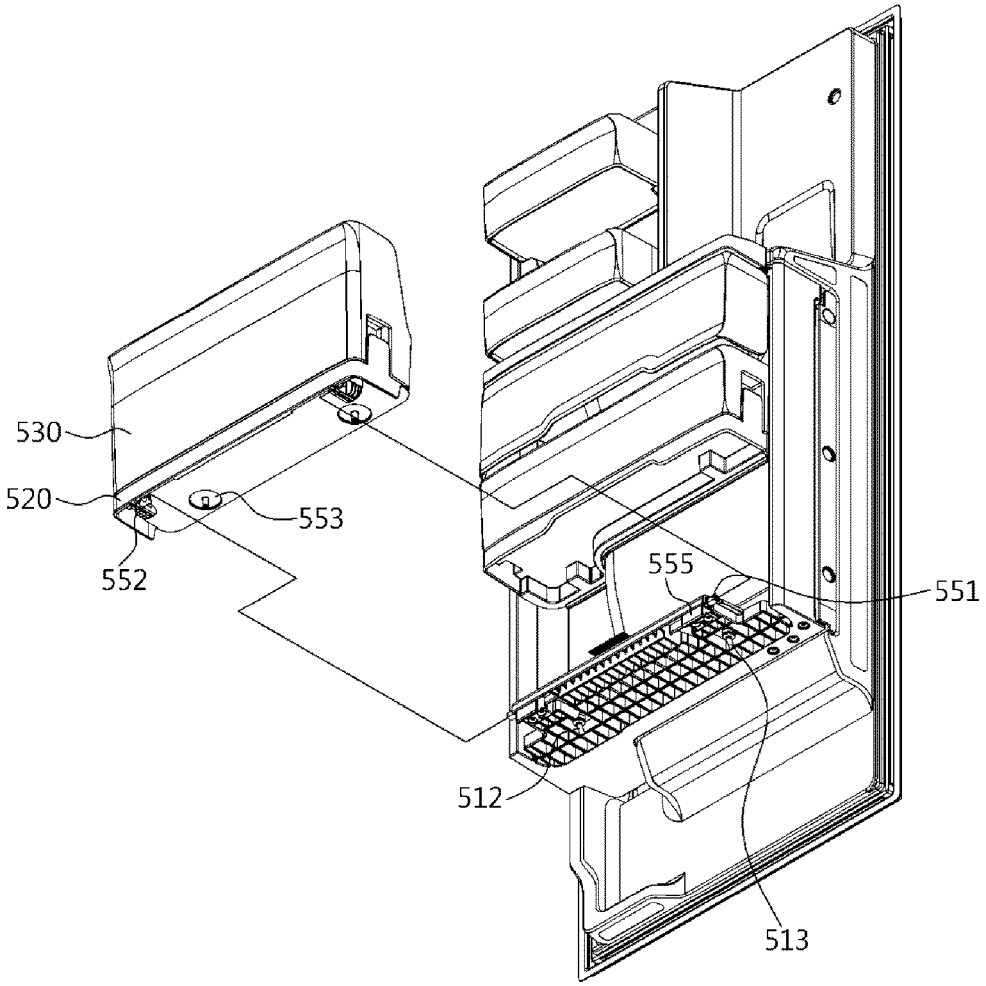
FIG. 38 is an exploded perspective view illustrating a tilt guard assembly of FIG. 37 when seen from bottom.

FIG. 37 is an exploded perspective view illustrating a tilt guard assembly when seen from above in accordance with another embodiment of the present disclosure, and FIG. 38 is an exploded perspective view illustrating a tilt guard assembly of FIG. 37 when seen from bottom.

Referring to FIGS. 37 and 38, according to another embodiment, a door guard assembly 500 may include a tilt body 510; a tray 520; a guard 530; and a tilt unit 550.

The tilt body 510 may be coupled to the rear surface of the door. The tilt body 510 may be provided such that the rear surface of the tilt body 510 makes contact with the rear panel 21*b* of the door. The tilt body 510 may form a storage space by being coupled to the tray 520 and the guard 530.

According to the embodiment, the tilt body 510 may include a tray supporter 512. The tray supporter 512 may be extended from a lower end of the tilt body 510 to a front side. An upper surface of the tray supporter 512 may have a flat plate shape.

A buffer hole 513 may be provided in one side of the upper surface of the tray supporter 512. The buffer hole 513 may be provided in plural. The buffer hole 513 may provide a space to which a buffer 553 is inserted. According to the embodiment, the buffer hole 513 may include a material having the elasticity.

The tray 520 may be formed to have a plate shape having a certain thickness. Together with the tilt body 510, the tray 520 may form the storage space on the rear surface of the door. On the tray 520, foods placed in the storage space in the rear surface of the door may be positioned. For example, the tray 520 may be provided in plural.

The guard 530 may form the storage space with the tray 520 and the tilt body 510. The guard 530 may include a front guard; and a side guard bent from opposite ends of the front guard to a rear side of the storage space. A bottom of the guard 530 may be fixed to a front end of the upper portion and the opposite sides of the tray 520.

The guard 530 may be formed of transparent material so that the food placed in the storage space allows to be viewed from the outside.

The tilt unit 550 may include a tilt rotation axis 551; a rotation axis coupling unit 552; a butter 553; and a rotation locking protrusion 555.

The tilt rotation axis 551 may be installed on a lower surface of the tray supporter 512. The tilt rotation axis 551 may be placed on a front side of the lower surface of the tray supporter 512. Two tilt rotation axis 551 may be provided in a position corresponding to the tray supporter 512. The tilt rotation axis 551 may be protruded on the lower surface of the tray supporter 512 to a left side and a right side.

The rotation axis coupling unit 552 may be installed in a front side of a lower surface of the tray 520. The rotation axis coupling unit 552 may be coupled to the tilt rotation axis 551 to provide a space in which the tilt rotation axis 551 is rotated.

The buffer 553 may be installed on one side of the lower surface of the tray 520. When seen from above, the buffer 553 may be disposed in a position overlapping with the buffer hole 513 placed in the upper surface of the tray 520. Particularly, when the storage space is maintained in a closed state, the buffer 553 may be inserted into the buffer hole 513. Accordingly, when the storage space is in a closed state, the tray 520 may be maintained in a stopped state.

The rotation locking protrusion 555 may be installed in one side of the front side of the lower surface of the tray supporter 512. One end of the rotation locking protrusion 555 may be coupled to the lower surface of the tray supporter 512, and the other end of the rotation locking protrusion 555 may be extended from the one end, which is coupled to the lower surface, to a lower side. The rotation locking protrusion 555 may limit a rotation so that the tray 520 is prevented from being rotated by more than a certain angle.

Hereinafter a motion in which the above-mentioned tilt guard assembly 500 is rotated will be described in details.

Figure 39:
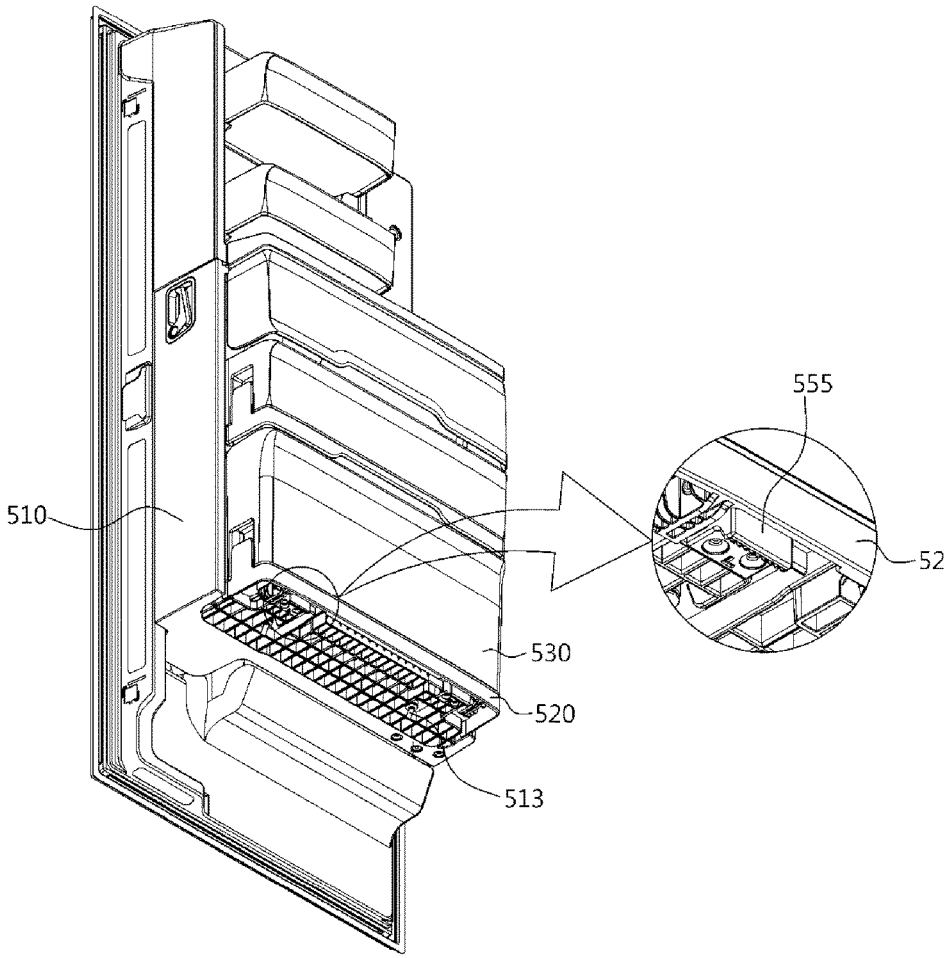
FIGS. 39 and 40 are views illustrating a motion in which a tilt guard assembly of FIG. 37 is rotated by a tilt unit.
Figure 40:
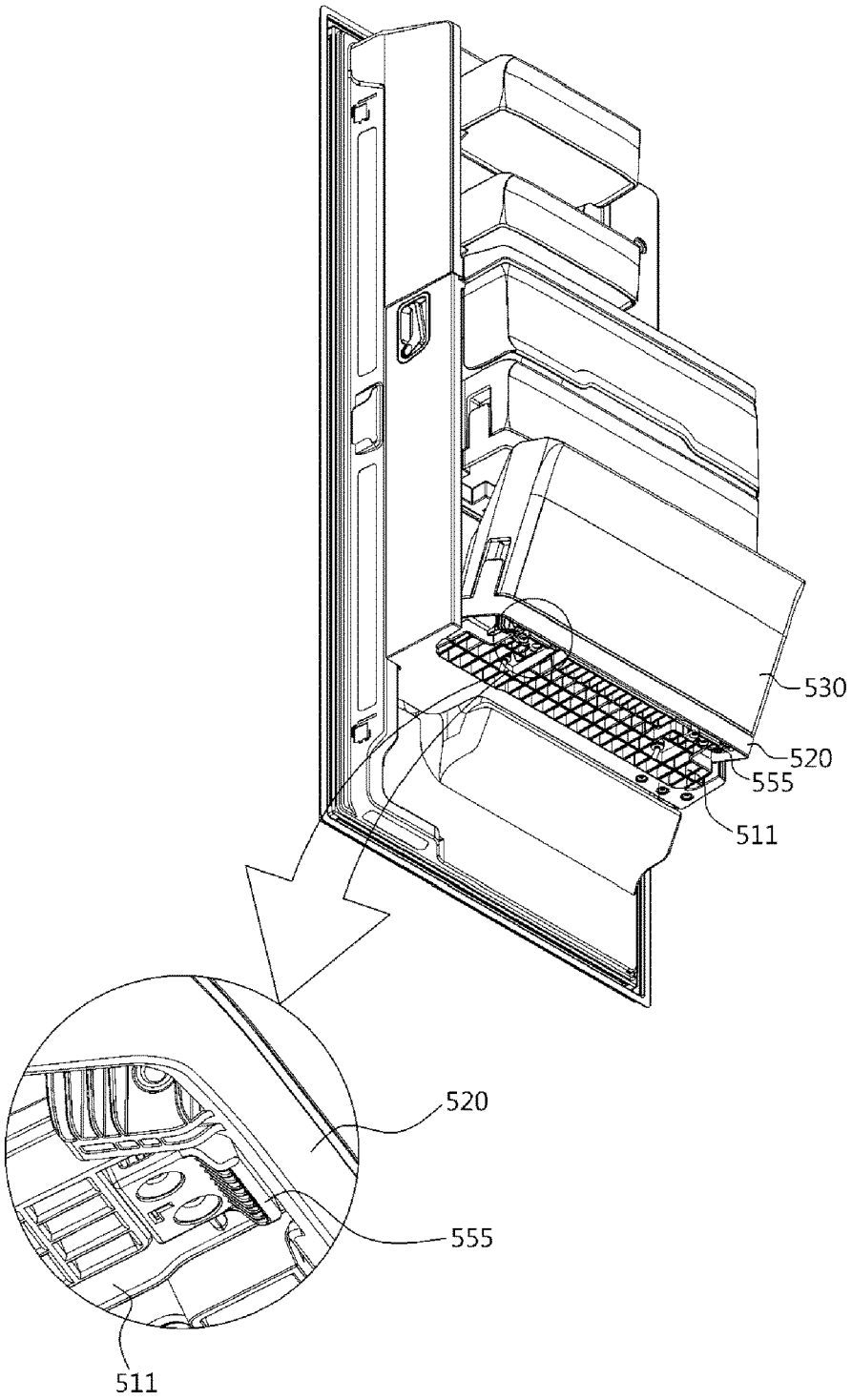

FIGS. 39 and 40 are views illustrating a motion in which a tilt guard assembly of FIG. 37 is rotated by a tilt unit.

The door guard assembly 500 may be provided such that the tray 520 is rotatable. The tray 520 may be rotated with respect to the tilt rotation axis 551 of the tilt unit. The tray 520 may be rotatable to allow the tray 520 to open or close the storage space.

Referring to FIG. 39, when the tray 520 is maintained in a closed state, the buffer 553 may be inserted into the buffer hole 513. The buffer 553 may be inserted into the buffer hole 513 having the elasticity and thus the buffer 553 may be not escaped from the buffer hole 513 unless a user applies a certain force. Accordingly, the tray 520 may be maintained in a closed state when an external force is not applied.

In addition, since the tilt rotation axis 551 is placed in the front side of the tray 520, the tray 520 may have a structure which is hardly rotated in an automatic manner without an external force.

Referring to FIG. 40, when a user applies a force to the guard 530 or the tray 520, the guard 530 and the tray 520 may be rotated. When the buffer 553 is escaped from the buffer hole 513 due to a user's force, the guard 530 and the tray 520 may be rotated.

When the tray 520 is rotated by more than a certain angle, the rotation locking protrusion 555 may be locked by the front end of the lower surface of the tray 520. Since the tray 520 is relatively rotated from the tray supporter 512 with respect to the tilt rotation axis 551, when the tray 520 is rotated by more than a certain angle, the front end of the lower surface of the tray 520 may be locked by the rotation locking protrusion 555 in a stopped state. By this way, the rotation of the tray 520 may be limited.

Figure 41:
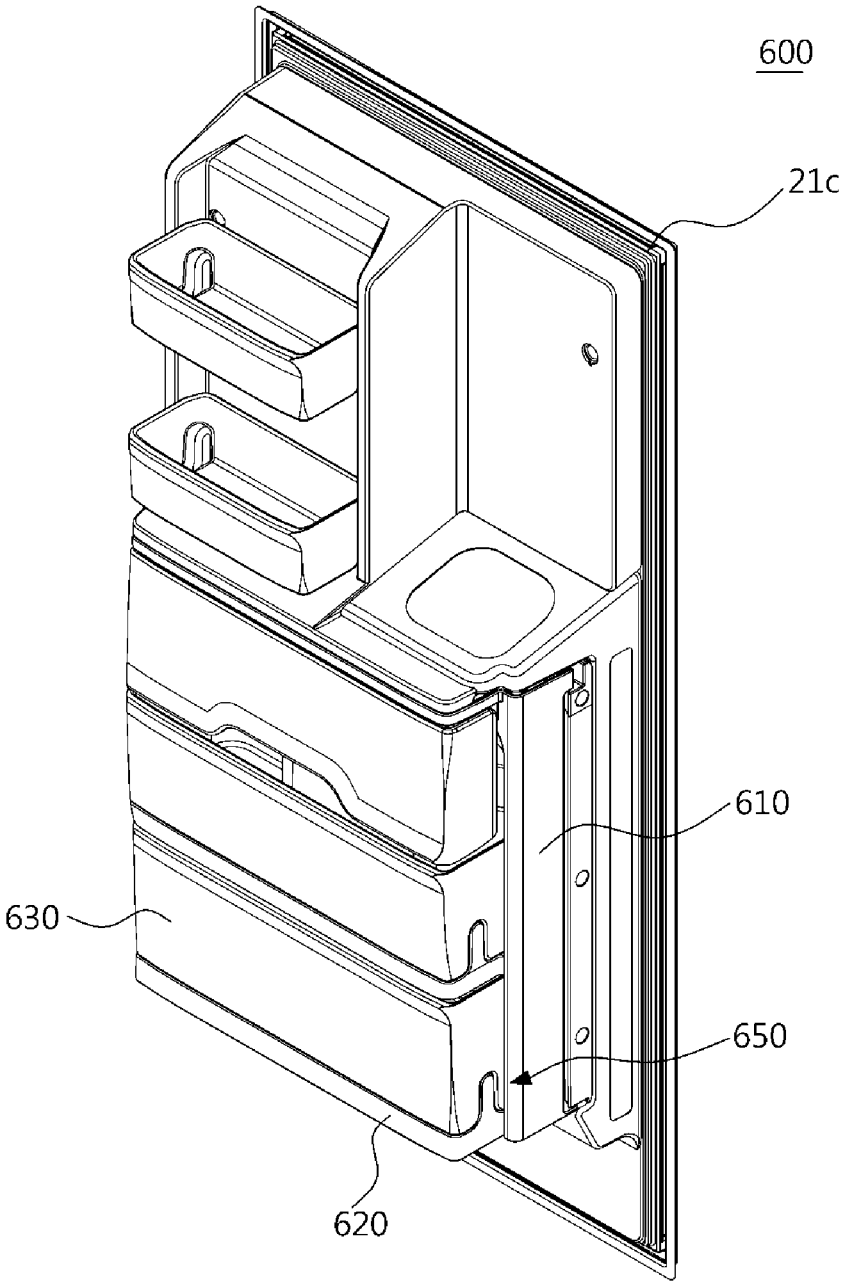
FIG. 41 is a perspective view illustrating a rotation guard assembly of a refrigerator of FIG. 2
Figure 42:
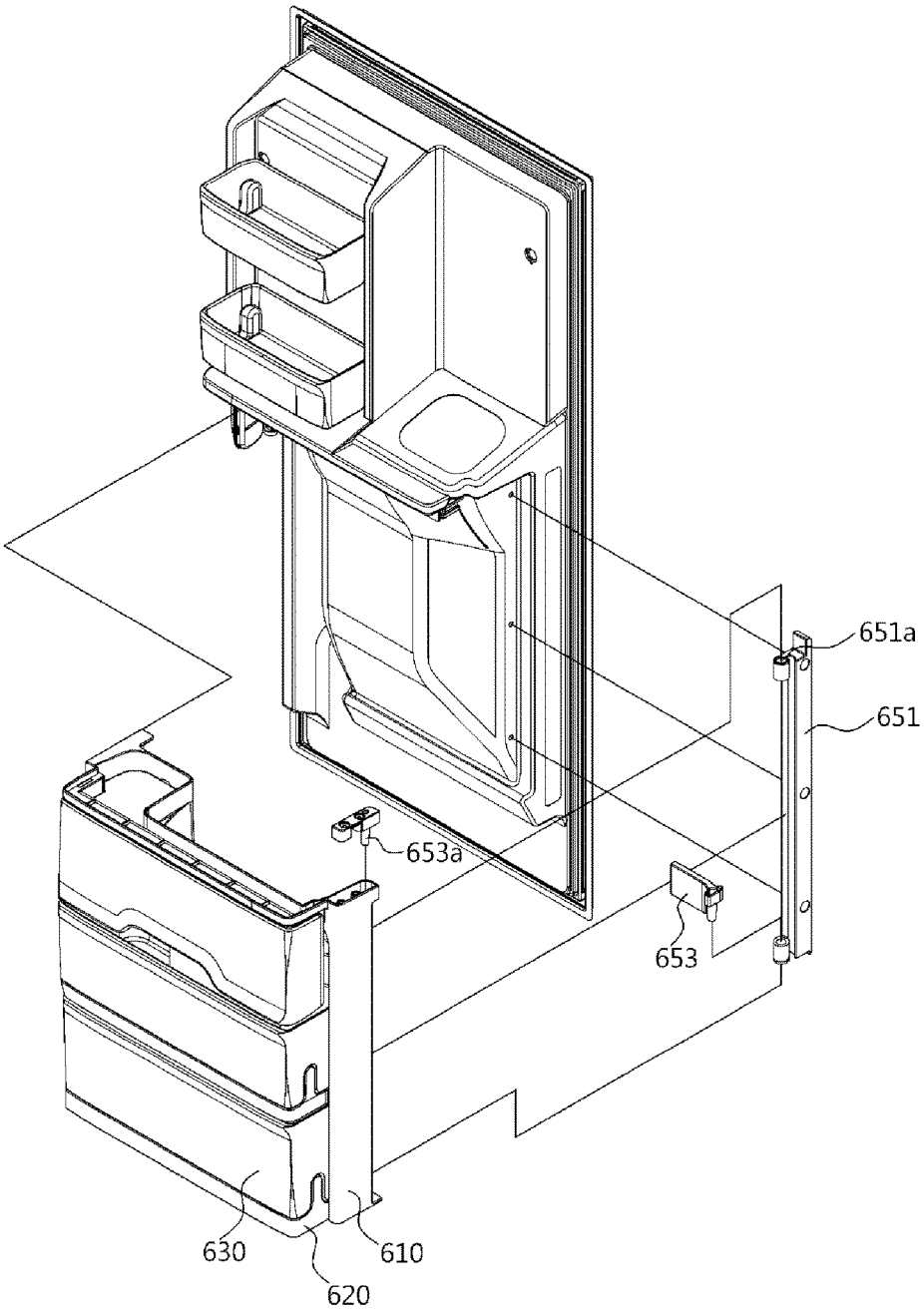
FIG. 42 is an exploded perspective view illustrating a rotation guard assembly of FIG. 41.

FIG. 41 is a perspective view illustrating a rotation guard assembly of a refrigerator of FIG. 2 and FIG. 42 is an exploded perspective view illustrating a rotation guard assembly of FIG. 41.

Referring to FIGS. 41 and 42, a rotation guard assembly 600 may include a rotation guard body 610; a tray 620; a guard 630 and a body rotation unit 650.

The rotation guard assembly 600 may be coupled to the rear panel 21*b* of the door, and the rotation guard assembly 600 may be placed in the refrigerating compartment when the door is closed. The rotation guard assembly 600 may be rotatable with respect to one side thereof coupled to the rear panel 21*b* of the door.

The rotation guard body 610 may be coupled to the rear surface of the door. The rotation guard body 610 may be provided such that a rear surface thereof makes contact with the rear panel 21*b* of the door. According to the embodiment, the rotation guard body 610 may be coupled to the rear surface of the door to provide a space in which the carbonated water production device is placed between the rotation guard body 610 and the rear surface of the door.

According to the embodiment, one side of the rotation guard body 610 may be coupled to the body rotation unit 650. The body rotation unit 650 may be coupled to an edge portion of one side of the rotation guard body 610. The body rotation unit 650 may be installed such that the rotation guard body 610 is rotatable with respect to the body rotation unit 650.

According to the embodiment, the body rotation unit 650 may include a rotation unit coupling unit 651 and a rotation unit hinge member 653. The rotation unit coupling unit 651 may be coupled to one side of the rotation guard body 610.

The rotation unit coupling unit 651 may have a hinge member coupling hole 651*a*. The hinge member coupling hole 651*a* may be installed in an upper side and a lower side of the rotation unit coupling unit 651, respectively. The hinge member coupling hole 651*a* may be provided such that the rotation unit hinge member 653 is inserted thereto and rotated.

The rotation unit hinge member 653 may have a rotation unit hinge axis 653*a*. The rotation unit hinge member 653 may be coupled to the rotation guard body 610 such that the rotation unit hinge axis 653*a* is passed through the hinge member coupling hole 651*a*. The rotation unit hinge member 653 may be provided to allow the rotation guard body 610 to be rotated with respect to the rotation unit hinge member 653. The rotation unit hinge member 653 may be provided in the number corresponding to the number of the hinge member coupling hole 651*a*.

The body rotation unit 650 may further include a door open switch 655. The door open switch 655 may be installed in one side of the rotation guard body 610. A user may convert a state of the rotation guard body 610 in which the rotation guard body 610 is fixed to the rear surface of the door to a state of the rotation guard body 610 in which the rotation guard body 610 is rotatable by adjusting the door open switch 655. Particularly, the door open switch 655 may fix the rotation guard body 610 to the rear surface of the door so that the rotation guard body 610 is maintained in a closed state. In addition, the door open switch 655 may convert into a state of the rotation guard body 610 in which the rotation guard body 610 is not fixed to the rear surface of the door when a user rotates the rotation guard assembly 600.

Figure 43:
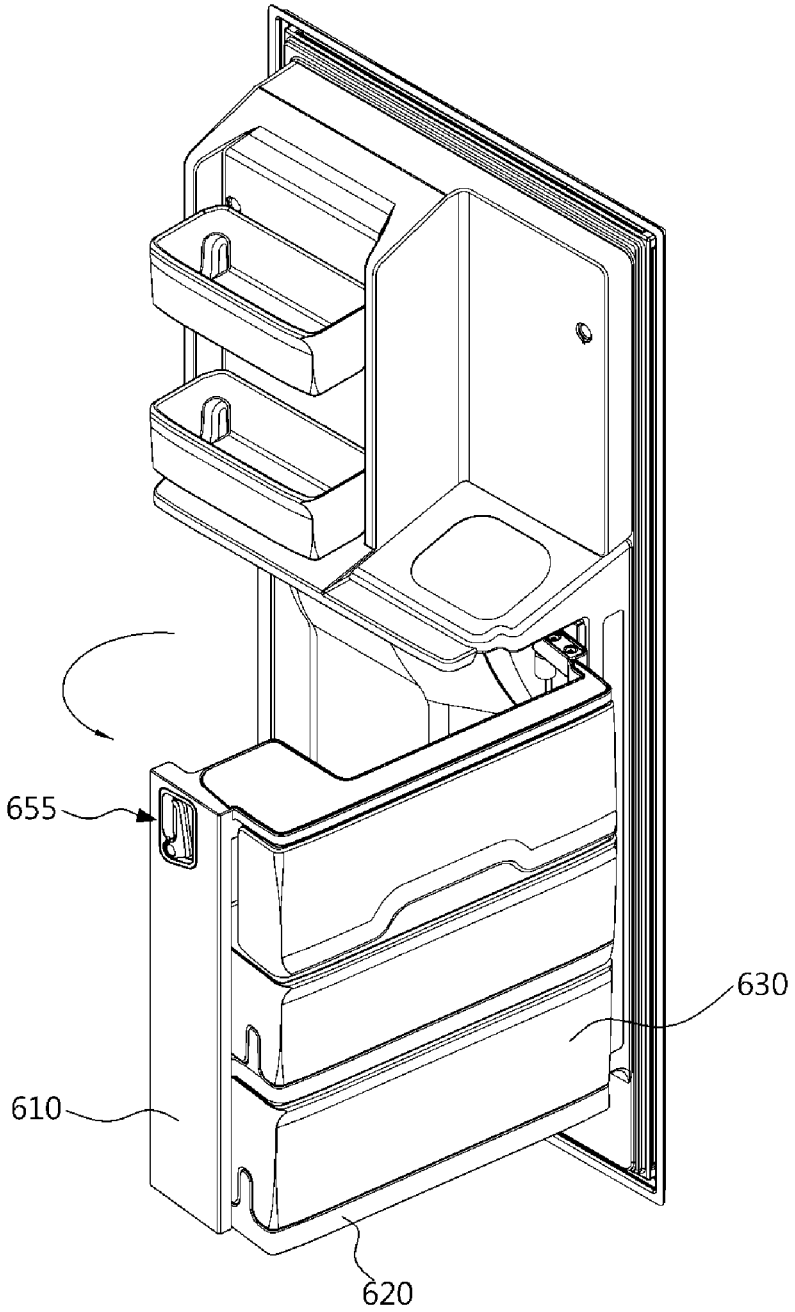
FIG. 43 is a view illustrating a motion in which a rotation guard assembly of FIG. 41 is rotated.

FIG. 43 is a view illustrating a motion in which a rotation guard assembly of FIG. 41 is rotated.

Referring to FIG. 43, the rotation guard body 610 may be rotatable with respect to the rotation unit hinge member 653.

According to the embodiment, the rotation guard assembly 600 may be provided in the rear surface of the door in which a dispenser (not shown) is installed. In a refrigerator configured to generate carbonated water, a carbonated water production device (not shown) may be installed in a rear surface of a door in which a dispenser (not show) is installed. A container into which carbon dioxide gas is injected may be needed to be continuously replaced in the carbonated water production device (not shown) to supply carbon dioxide gas. According to the embodiment of the present disclosure, in the refrigerator, the carbonated water production device (not shown) and the rotation guard assembly 600 may be provided in the rear surface of the door in which the dispenser (not shown) is installed. The carbonated water production device (not shown) may be disposed between the rear surface of the door and the rotation guard assembly 600. Therefore, in a case of the carbonated water production device (not shown), when replacing a container into which carbon dioxide gas is injected, a work related to the carbonated water production device (not shown) may be performed by rotating the rotation guard assembly 600.

Hereinbefore it is described that the rotation guard assembly 600 is installed in the door in which the dispenser (not shown) is installed. However, the rotation guard assembly 600 may be installed in any types of door of refrigerator regardless of the installation of the dispenser (not shown).

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A method for producing a door assembly configured to open and close a storage compartment of a refrigerator comprising:

coupling a connection member to an upper portion or a lower portion of a front panel, the front panel including a first coupling part extended from an upper end to an inner side and a second coupling part provided with a coupling hole and configured to be extended from one side of the first coupling part to a lower side;

coupling a door cap to the connection member; and coupling a rear panel to a rear surface of the front panel and the door cap, wherein the front panel is fixed to the door cap by coupling of the door cap to the connection member coupled to the front panel, and during the coupling of the connection member to the front panel, a locking member provided in the connection member is insertedly coupled to the coupling hole.

2. The method of claim 1 wherein during the coupling of the connection member to the front panel, the locking member is coupled to the coupling hole in a state in which the second coupling part is inserted into a groove provided in one side of the connection member.

3. The method of claim 2 wherein the connection member further comprises a guide provided outside of the groove to have a shape corresponding to a space surrounded by a front side of the front panel, the first coupling part and the second coupling part, wherein during the coupling of the connection member to the front panel, the guide is moved to the upper portion along the inner side of the front panel to couple the connection member to the front panel.

4. The method of claim 1 wherein the coupling hole is a first coupling hole, and during the coupling of the door cap to the connection member, a door cap coupling member provided in the door cap is insertedly coupled to a second coupling hole provided in one side of the connection member.

5. The method of claim 4, wherein the coupling hole is a first coupling hole, and the connection member further comprises a first groove and a second groove provided in parallel to the first groove, wherein during the coupling of the door cap to the connection member, the door cap coupling member is insertedly coupled to a second coupling hole provided inside of the second groove.

6. The method of claim 5 wherein the second groove is provided at a more inner side of the door assembly than the first groove.

* * * * *